US011897718B2

(12) United States Patent
Russell et al.

(10) Patent No.: US 11,897,718 B2
(45) Date of Patent: Feb. 13, 2024

(54) TAPE EDGE FOLDING ROLLER

(71) Applicant: Intertape Polymer Corp., Sarasota, FL (US)

(72) Inventors: Gregory Russell, Oxford, CT (US); Endre Hivatal, Tampa, FL (US)

(73) Assignee: Intertape Polymer Corp., Sarasota, FL (US)

( * ) Notice: Subject to any disclaimer, the term of this patent is extended or adjusted under 35 U.S.C. 154(b) by 318 days.

(21) Appl. No.: 17/343,299

(22) Filed: Jun. 9, 2021

(65) Prior Publication Data

US 2022/0396449 A1 Dec. 15, 2022

(51) Int. Cl.

| | |
|---|---|
| ***B65H 35/00*** | (2006.01) |
| ***B65H 37/06*** | (2006.01) |
| ***B65H 27/00*** | (2006.01) |
| ***B65H 45/22*** | (2006.01) |

(52) U.S. Cl.

CPC ..... *B65H 35/0033* (2013.01); *B65H 27/00* (2013.01); *B65H 37/06* (2013.01); *B65H 45/22* (2013.01); *B65H 2701/1315* (2013.01)

(58) Field of Classification Search

None

See application file for complete search history.

(56) References Cited

U.S. PATENT DOCUMENTS

| | | | | |
|---|---|---|---|---|
| 4,576,674 | A | 3/1986 | Le Tarte | |
| 6,824,637 | B2 | 11/2004 | Mullet et al. | |
| 7,537,036 | B2 | 5/2009 | Namekawa et al. | |
| 8,393,375 | B2 * | 3/2013 | Lam | B65H 45/22 156/478 |
| 9,457,923 | B2 * | 10/2016 | Lam | B65H 23/14 |

FOREIGN PATENT DOCUMENTS

| | | | |
|---|---|---|---|
| JP | H0640644 | A | 2/1994 |
| JP | 2001199620 | A | 7/2001 |

* cited by examiner

*Primary Examiner* — Barbara J Musser

(74) *Attorney, Agent, or Firm* — Moore & Van Allen PLLC; Jeffrey R. Gray

(57) ABSTRACT

A tape applicator configured for applying a tape to a carton (e.g., for sealing and/or assembling the carton). The tape applicator may include an edge folder assembly having an edge folder roller operatively coupled to a support member that allows the edge folder roller to rotate around the support member. The edge folder assembly may also include an alignment assembly (e.g., a self-alignment assembly) that allows the edge folder roller to move axially along the support member. The alignment assembly may comprise one or more biasing members (e.g., springs, or the like) and/or one or more restraining members (e.g., washers, or the like) to aid in allowing the edge folder roller to rotate and/or move axially with respect to the one or more support members in order to account for shifting of the tape transversely through the tape applicator.

21 Claims, 21 Drawing Sheets

TAPE EDGE FOLDING ROLLER

FIELD

The present invention relates to a tape applicator (tape head) that folds an edge(s) of tape before applying it to a carton, and in particular, to a tape applicator having a roller assembly that folds the edge(s) of the tape.

BACKGROUND

Industrial tape heads, also known as tape applicators or cartridges, employ components for folding edges of tape before the tape is applied to a carton, such as a cardboard box. In particular, a static member, such as a bracket, is often utilized to fold the edge(s) of tape as it passes by the static member.

SUMMARY

Embodiments of the present disclosure include a tape applicator configured for applying a tape, such as a pressure sensitive adhesive tape, to a carton (e.g., for sealing and/or assembling the carton). The tape applicator may include an edge folder assembly (e.g., otherwise described as an edge folder roller assembly, or the like) comprising an edge folder roller, one or more support members (e.g., one or more shafts, or the like) for operatively coupling the edge folder roller to the tape applicator and/or allowing the edge folder roller to rotate around a support member, and/or an alignment assembly (e.g., a self-alignment assembly) that allows the edge folder roller to move axially along the one or more support members. The alignment assembly may comprise one or more biasing members (e.g., springs, or the like) and/or one or more restraining members (e.g., washers, or the like) to aid in allowing the edge folder roller to rotate and/or move axially with respect to the one or more support members in order to account for potential issued with the tape and/or tape applicator. For example, the alignment assembly accounts for shifting of the tape within the tape applicator due to tolerances of the components in the routing of the tape through the tape applicator, offset between the tape and core (e.g., paper core) of the tape roll, offset in the layers of tape that may cause the tape to shift transversely with respect to the machine direction (e.g., telescoped tape having concave and convex surfaces on either side of the tape), or other like potential issues, which will be discussed in further detail herein.

The edge folder roller may comprise an inner roller portion and/or one or more outer projection portions (e.g., rims, or the like). The one or more outer projection portions may comprise a first outer projection (e.g., first rim, or the like) adjacent a first end of the inner roller portion and/or a second outer projection (e.g., second rim, or the like) adjacent a second end of the inner roller portion. The inner roller portion and/or the one or more outer projections may be shaped to aid in folding one or more edges of the tape (e.g., a single edge or both edges of the tape). For example, the inner roller portion may have a curved surface, such as, a curved surface extending from the middle of the inner roller portion to the first end and/or the second of the inner roller portion (e.g., the diameter of the inner roller portion may be larger in the middle and be reduced at the ends before the projection portions). Moreover, the one or more outer projection portions may be curved inwardly towards the inner roller portion. One or more of these curved surfaces may aid in directing the edges of the tape to be folded over (e.g., by creating a u-shaped or v-shaped pocket, or the like) such that the adhesive on the folded edge may adhere to the adhesive face of the tape.

The edge folder roller assembly may further comprise one or more additional rollers, such as a knurled roller (e.g., a clutch roller that restricts the tape from recoiling back upstream), a guide roller (e.g., leg length roller that regulates leg length of the tape), or other like rollers. The edge folder roller assembly may further comprise one or more mounting members that allow the edge folder roller assembly to be mounted to the tape applicator.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE DRAWINGS

The drawings illustrate embodiments of the invention, and are not necessarily drawn to scale, wherein.

DETAILED DESCRIPTION

Figure 1:
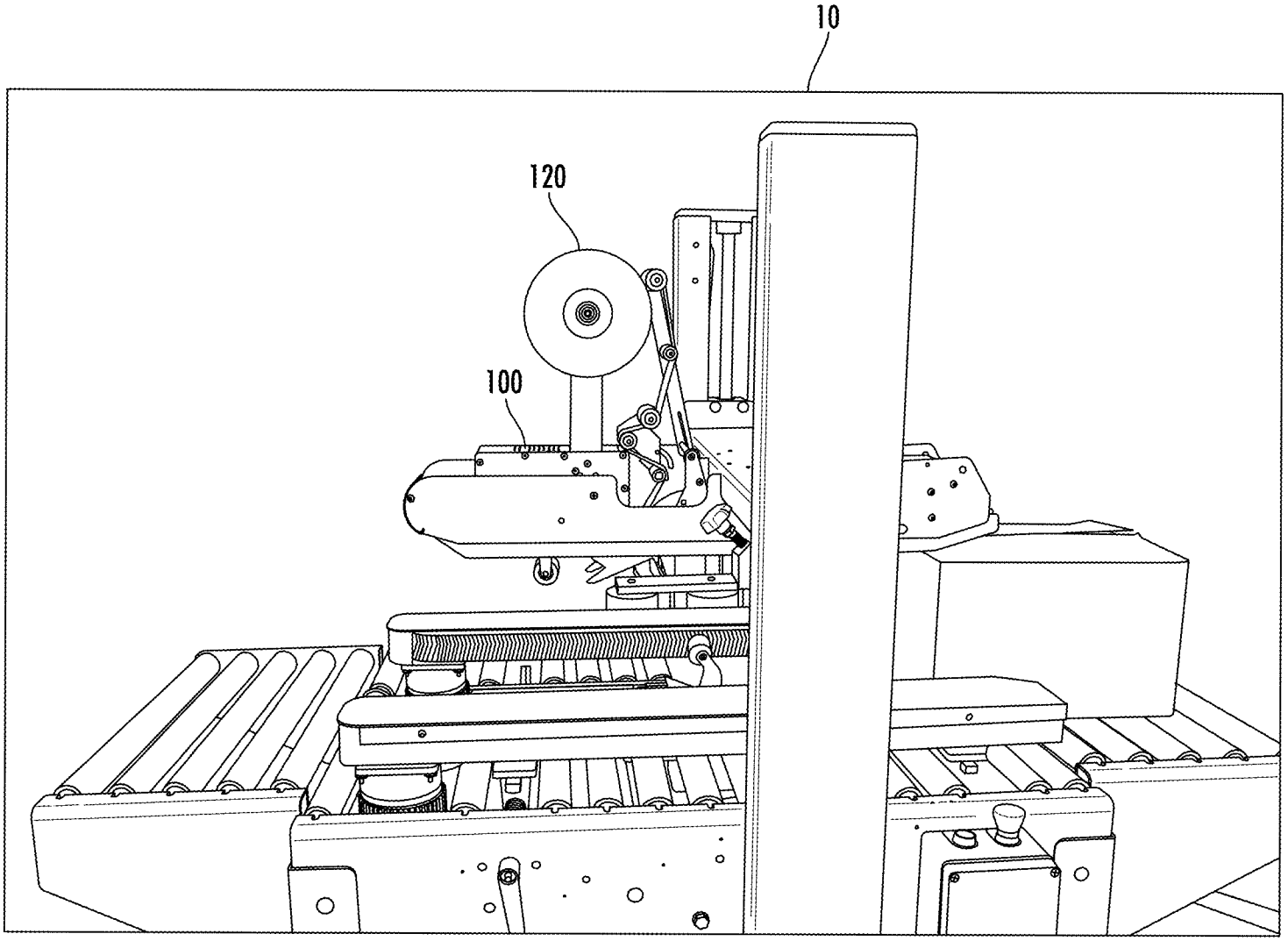
FIG. 1 is a perspective view of a carton sealing machine, in accordance with embodiments of the present disclosure.

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

In some implementations, consistent with the present disclosure a cartoning machine 10 may have a tape applicator 100 configured for applying a tape T, such as a pressure sensitive adhesive tape, to a carton (e.g., for sealing and/or assembling the carton). The tape applicator 100 may include an edge folder assembly 200 (otherwise described as an edge folder roller assembly, or the like) comprising an edge folder roller 210, one or more support members 240 (otherwise described as one or more roller support members, or the like) for allowing the edge folder roller 210 to rotate around a support member 240, and/or an alignment assembly 260 (otherwise described as a self-alignment assembly, or the like) that allows the edge folder roller to move axially along the one or more support members 240. The alignment assembly 260 may comprise one or more biasing members 270 (e.g., springs, or the like) and/or one or more restraining members 280 (e.g., washers, or the like) to aid in allowing the edge folder roller 210 to rotate and/or move axially with respect to the one or more support members 240. The edge folder roller assembly 200 may further comprise one or more additional rollers, such as a clutch roller 320 (e.g., a clutch roller that restricts the tape from recoiling back upstream) which may be referred to a knurled roller 320 (e.g., when the clutch roller has knurled projections), a guide roller 330 (e.g., leg length roller that regulates leg length of the tape over the side of the carton), or other like rollers. The edge folder assembly 200 will be described in further detail herein in the description of the tape applicator 100.

As illustrated in FIGS. 1 through 5B, a tape applicator 100 (otherwise called a tape head) of a cartoning machine 10 is disclosed that includes an improved edge folder assembly 200. In the illustrative embodiment, the tape head 100 includes a main frame 108 on which the various operating parts of the tape applicator 100 are mounted and a cover plate 109 protecting the various operating parts. The tape roll support arm 110 is operatively coupled to (e.g., mounted on, or the like) and extends from the main frame 108 and has adjacent to its free end 112 a rotatable hub 114 (e.g., otherwise described as a spindle, mandrel, or the like) mounted on a shaft 116 on which the tape roll 120 is operatively coupled (e.g., mounted, or the like) and from which a ribbon of tape T is dispensed along a tape path. The tape rolls 120 may be any size or range in any size. However, in some embodiments a new tape roll 120 may have an outside diameter of approximately 16 inches (or any other diameter based on the type of roll) and may weigh approximately 14 pounds (or have any other weight based on the type of roll). During operation of the tape applicator 100, the tape roll 120 may be consumed, such that the outside diameter and the weight of the tape roll 120 decrease. After the tape roll 120 is consumed, the outside diameter of the stub (or core) of the tape roll (with some remaining tape or without any tape) may be approximately 3 inches (or any other diameter based on the type of roll) and may weigh approximately 0.5 pounds (or any other weight based on the type of tape roll and stub material).

As further illustrated in FIGS. 1 through 5B, the tape T passes over a peel-off roller 124 operatively coupled (e.g., mounted, or the like) to a peel-off arm 126. The peel-off roller 124 may be positioned at or proximate a free end 128 of the peel-off arm 126 proximate (e.g., adjacent to, or the like) the tape roll 120. The peel-off arm 126 may be pivotably mounted to the main frame 108, and its free end 128 may be biased by a pivot biasing member 125 (e.g., spring, such as a torsion spring, or the like) toward the roll 120 to hold the peel-off roller 124 in contact with the periphery of the tape roll 120. As such, the pivot biasing member 125 allows the peel-off roller 124 to move in an arc between the full diameter (e.g., 16 inch outside diameter, or the like depending on the size of the roll) of a tape roll 120 to a stub diameter (e.g., 3 inch outside diameter, or the like depending on the size of the roll) of the tape roll 120 after the tape has been consumed or mostly consumed. The pivot biasing member 125 that biases the peel-off roller 124 against the tape roll 120 may aid in regulating over spin of the tape roll 120. That is, without holding (e.g., biasing) the peel-off roller 124 against the tape roll 120, the tape roll 120 may over spin (e.g., more than a half-turn) after sealing a first box, and consequently the tape applicator 100 would have to pull the excess tape taught and/or spin the tape roll 120 in the reverse direction to the peel-off location of the peel-off roller 124 in order to allow the tape applicator 100 to seal a second box. Moreover, in addition to moving in an arc, the peel-off arm 126 may include a damper member (not illustrated), such as, one or more compression springs (e.g., two compression springs, or the like) that act as a shock absorber in order to absorb forces during operation of the tape applicator 100. When a damper member is used, it allows the length of the peel-off arm 126 to change (e.g., as one or more rods slide with respect to the housing through the compression springs), and thus, allows the peel-off roller 124 to move along with the changing length of the peel-off arm 126. After peeling the tape T off the roll 120 using the peel-off roller 124, one or more guide rollers (e.g., peel-off arm guide rollers 130) located on the peel off arm 126 or another location on the tape applicator 100, aid in guiding the tape T to the edge folder assembly 200 (e.g., in particular, to the edge folding roller 210 of the edge folder assembly).

The edge folder assembly 200 is generally illustrated in FIGS. 2 through 5B but will be described in further detail with respect to FIGS. 6 through 11. However, it should be understood that other embodiments of the edge folder assembly 200 and/or the components thereof may be utilized, such as in alternate configurations and/or in alternate locations on the tape applicator 100 (e.g., near the peel-off arm, in the front applicator arm 137, or the like). The edge folder assembly 200 (e.g., otherwise described as an edge folder roller assembly, or the like) may comprise an edge folder roller 210 and one or more roller support members 240 (e.g., one or more shafts 242, or the like) for operatively coupling the edge folder roller 210 to the tape applicator 100 and allowing the edge folder roller 210 rotate around a roller support member 240. The edge folder assembly 200 may further comprise an adjustment assembly 260 (e.g., otherwise described as an edge folder roller adjustment assembly, a roller adjustment assembly, or the like) that allows the edge folder roller 210 to move axially with respect to the axis of the one or more roller support members 240. The one or more edge roller support members 240 may be illustrated as a single shaft 242; however, it should be understood that the multiple shafts may be operatively coupled together to allow the edge folder roller 210 to rotate around the multiple shafts.

The edge roller adjustment assembly 260 may comprise one or more biasing members 270 (e.g., springs 272, 274, or the like) and/or one or more restraining members 280 (e.g., washers 282, 283, 284, 285 or the like) to aid in allowing the edge folder roller 210 move axially and rotate with respect to the one or more roller support members 240. The one or more restraining members 280 (e.g., washers, or the like) hold the biasing members 270 (e.g., springs 272, 274) in place adjacent the edge folder roller 210. The edge roller adjustment assembly 260 may further comprise one or more locking members 290 (e.g., fasteners, nuts, pins, clamps, clips, or the like) operatively coupled to the one or more roller support members 240 in order to operatively couple the adjustment assembly 260 to the edge folder roller 210 and/or the one or more roller support members 240. For example, the one or more biasing members 280 may position the edge folder roller 210 in a home position (e.g., resting position), as well as allowing the edge folder to move axially with respect to the one or more roller support members 240 (e.g., side to side) away from the home position as the tape T passes over the edge folder roller 210.

The adjustment assembly 260 allows for movement of the tape T (e.g., transversely from the machine direction) as the tape T is being dispensed and/or due to the use of different tape rolls, as discussed in further detail below. The movement of the tape T through the tape applicator 100 may cause the tape T shift, and thus, exert a force on the edge folder roller 210. By allowing the edge folder roller 210 to move axially with respect to the one or more support members 240, the edges of the tape T may be folded over in the same or similar way even when the tape T shifts within the tape applicator 100. That is, the folded edges of the tape T may be generally uniform even when the tape T shifts within the tape applicator 100. As such, the edge folder roller 210 provides an improvement over static edge folding brackets that cannot account for tape T that shifts within the tape applicator 100.

In some embodiments, the components of the tape applicator 100 (e.g., tolerance differences between tape applicator 100 components, loose components, or the like) may cause shifting of the tape T as it passes through the tape applicator 100. In other situations, if the tape roll is telescoped (e.g., one side of the tape roll is concaved, one side of the tape roll is convex), the tape T may shift in the tape applicator 100. In other situations, the tape T may be offset from the stub (e.g., paper core) such that between different rolls the position of the tape may shift transversely within the tape applicator 100 (e.g., 1/16, 1/8, 3/16, 1/4, or other like inches within the tape applicator, or a range between, overlapping, or falling outside of these values). Consequently, the tape T running through the applicator 100 may be located in different positions over time (e.g., different transverse locations). The change in the transverse position of the tape T would typically require adjustment of the alignment of a conventional static folding member in order to fold the tape properly, or without adjustment of the static folding member, it may not properly fold the edges of the tape T (e.g., one side of the edge may be folded while the other edge is not folded, or the like). As such, the adjustment assembly 260 of the edge folder assembly 200 provides dynamic self-aligning of the tape T without having to adjust a static folding member. In one example, if the tape width is 53 mm wide, and the edge roller opening (e.g., between projections 230) is restricted to 48 mm, the edge roller 210 and the adjustment assembly 260 will curl the tape T on each edge to a width of approximately 2.5 mm. The self-alignment of the adjustment assembly 260 allows the fold on each edge of the tape T to generally have the same width (e.g., 2.5 mm in the illustrated example). However, it should be understood that in some embodiments the transverse movement of the edge roller 210 on the edge roller support member 242 is gradual (e.g., in the case of a telescoped tape roll). Consequently, even with the adjustment assembly 260 of the edge folder assembly 200, the width of the fold on each end may vary (e.g., vary 10, 20, 30, 40, 50, or the like percent) as the edge roller 210 moves with respect to the edge roller support member 240. The operation of the edge folder adjustment assembly 260 will be described in further detail with respect to FIGS. 12A through 13C and the process illustrated in FIG. 14.

Figure 6:
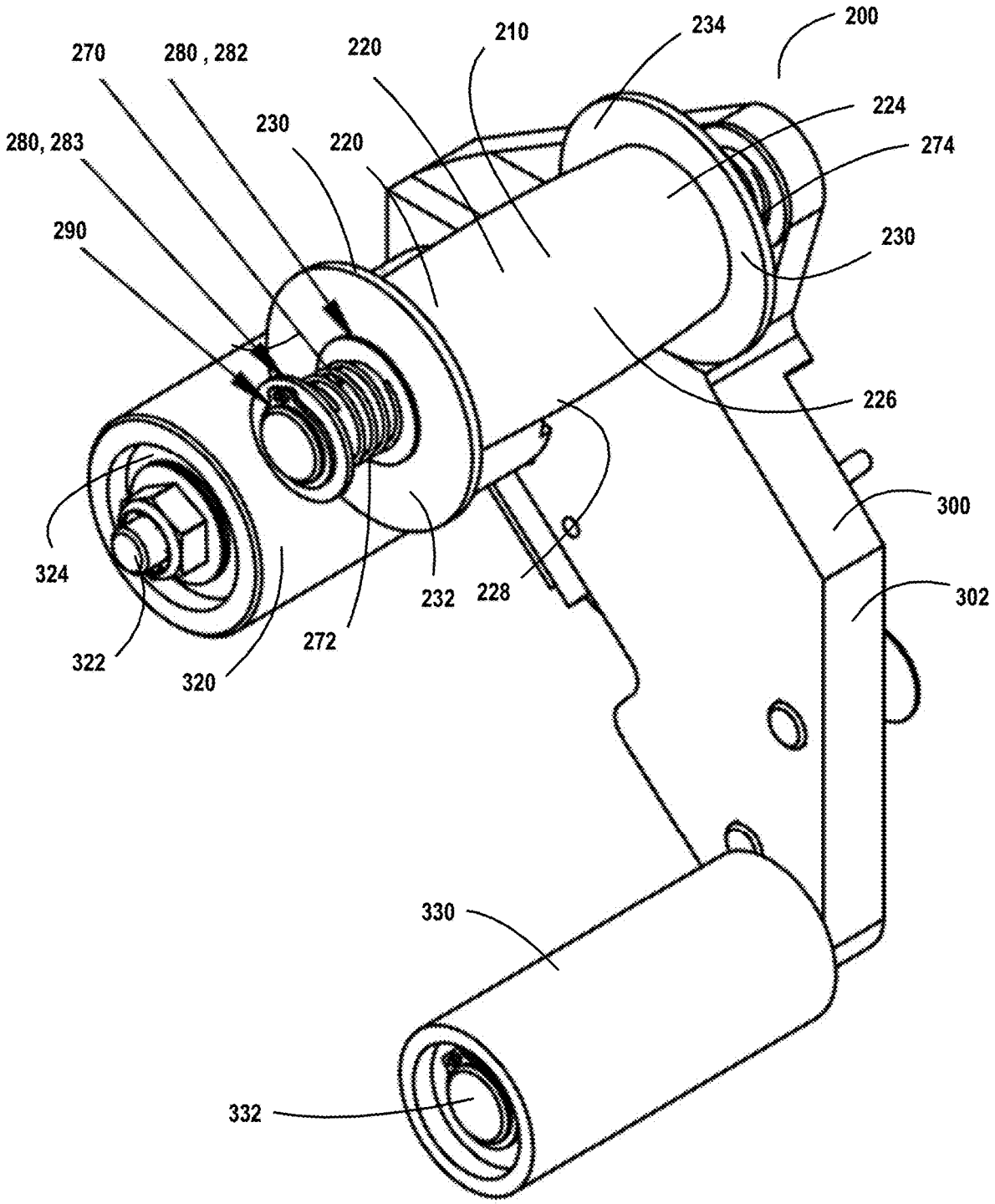
FIG. 6 is a perspective first side view of an edge folder roller assembly, in accordance with embodiments of the present disclosure.
Figure 7:
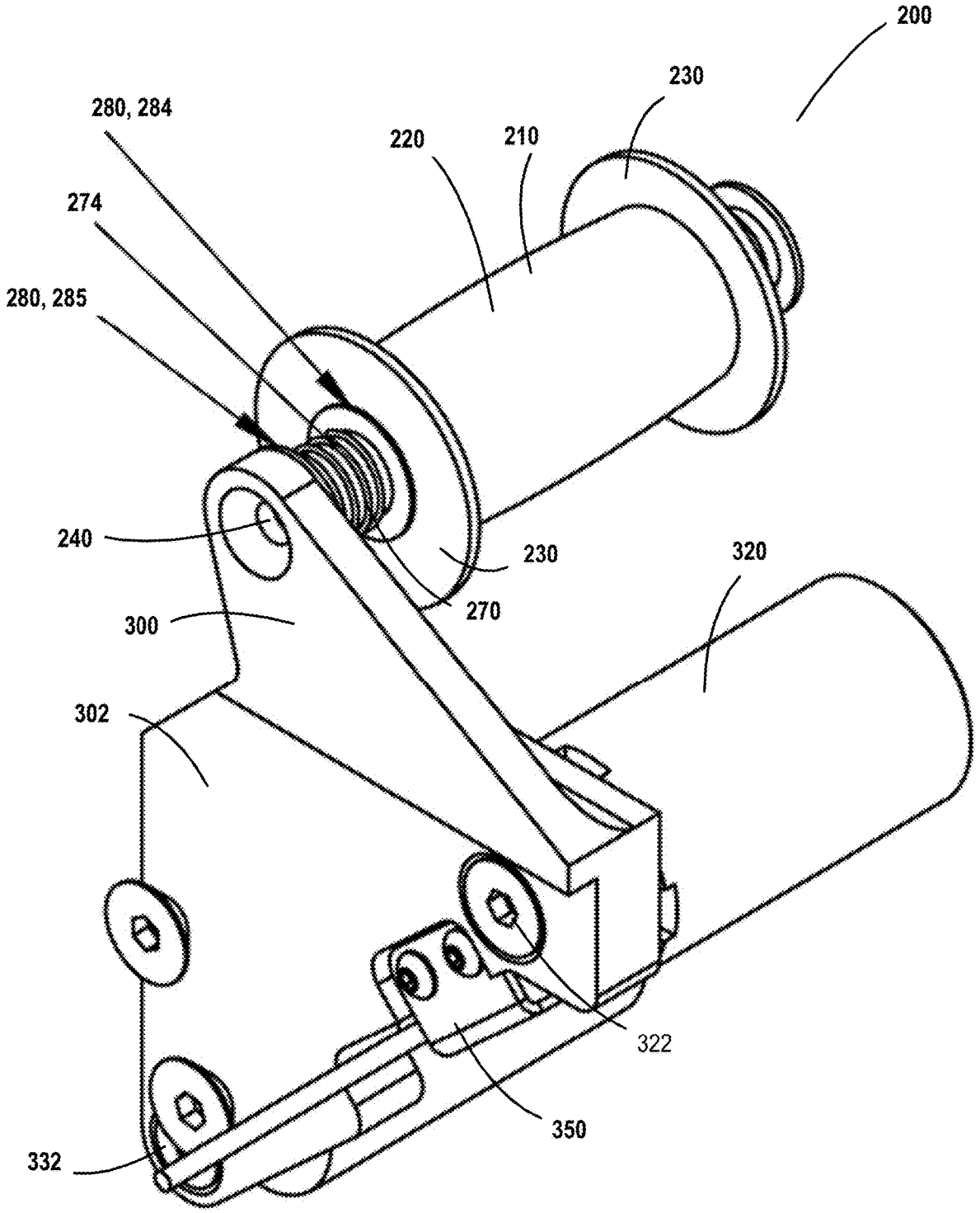
FIG. 7 is a perspective second side view of an edge folder roller assembly, in accordance with embodiments of the present disclosure.
Figure 8:
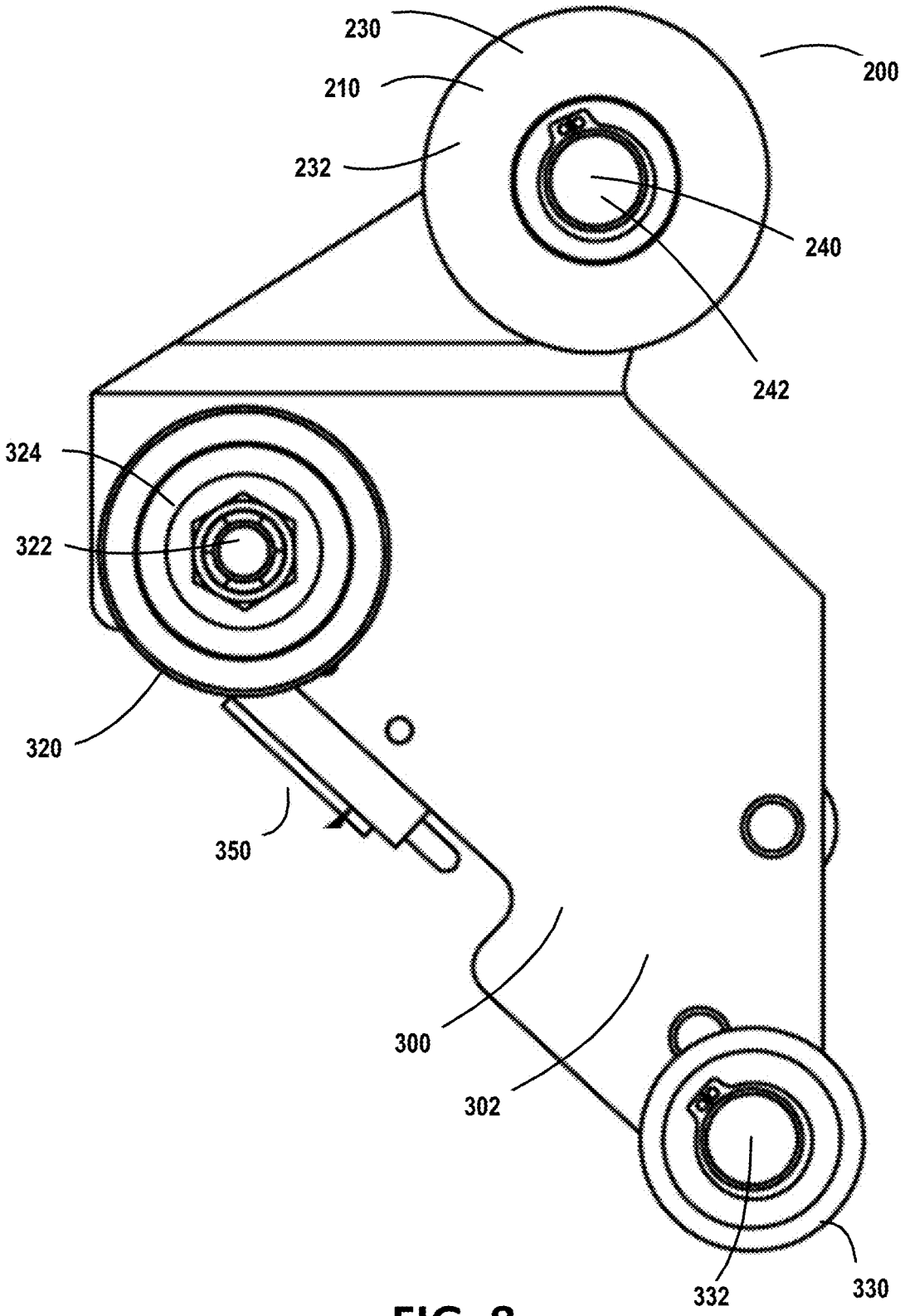
FIG. 8 is a first side view of an edge folder roller assembly, in accordance with embodiments of the present disclosure.
Figure 9:
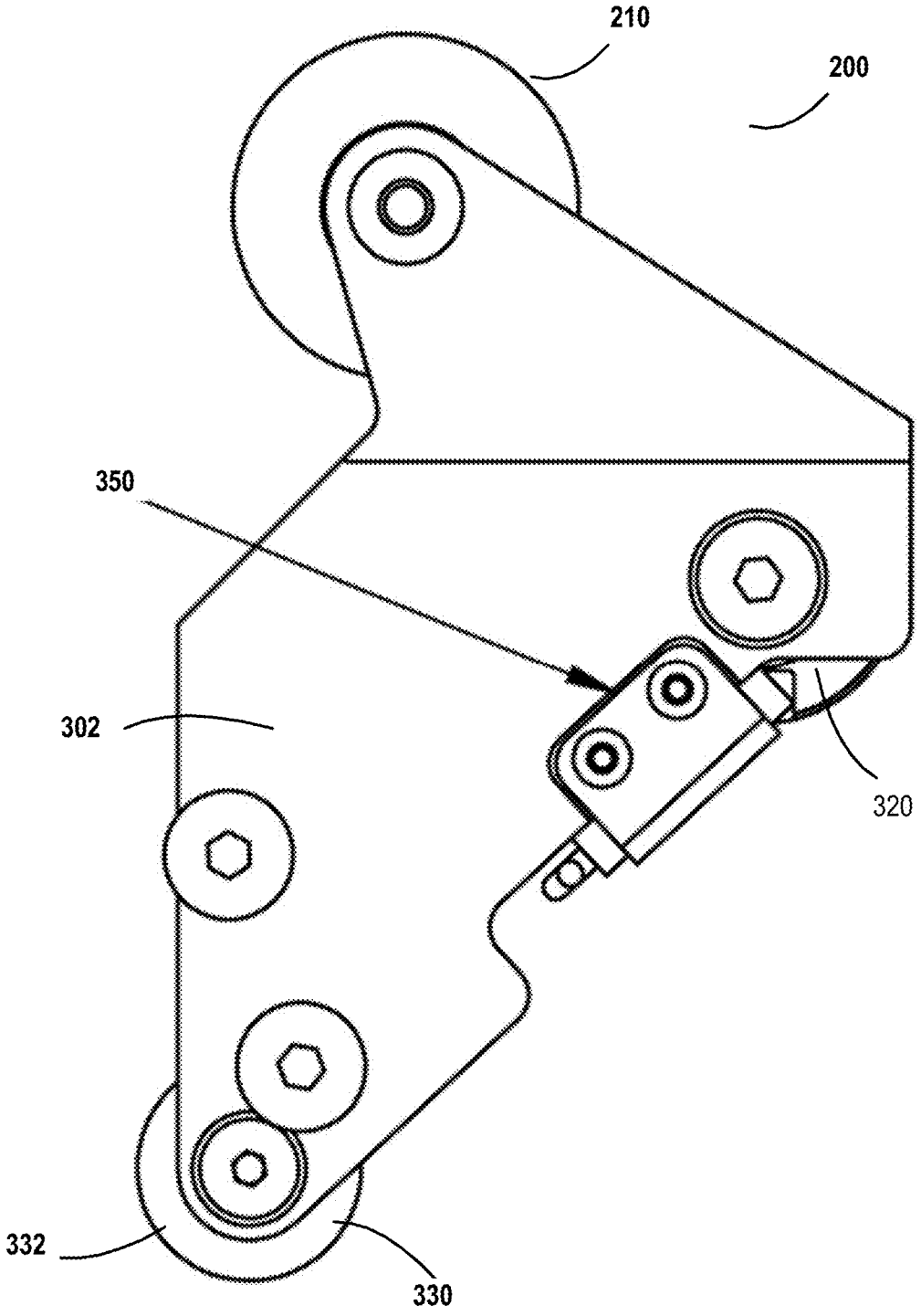
FIG. 9 is a second side view of an edge folder roller assembly, in accordance with embodiments of the present disclosure.
Figure 10:
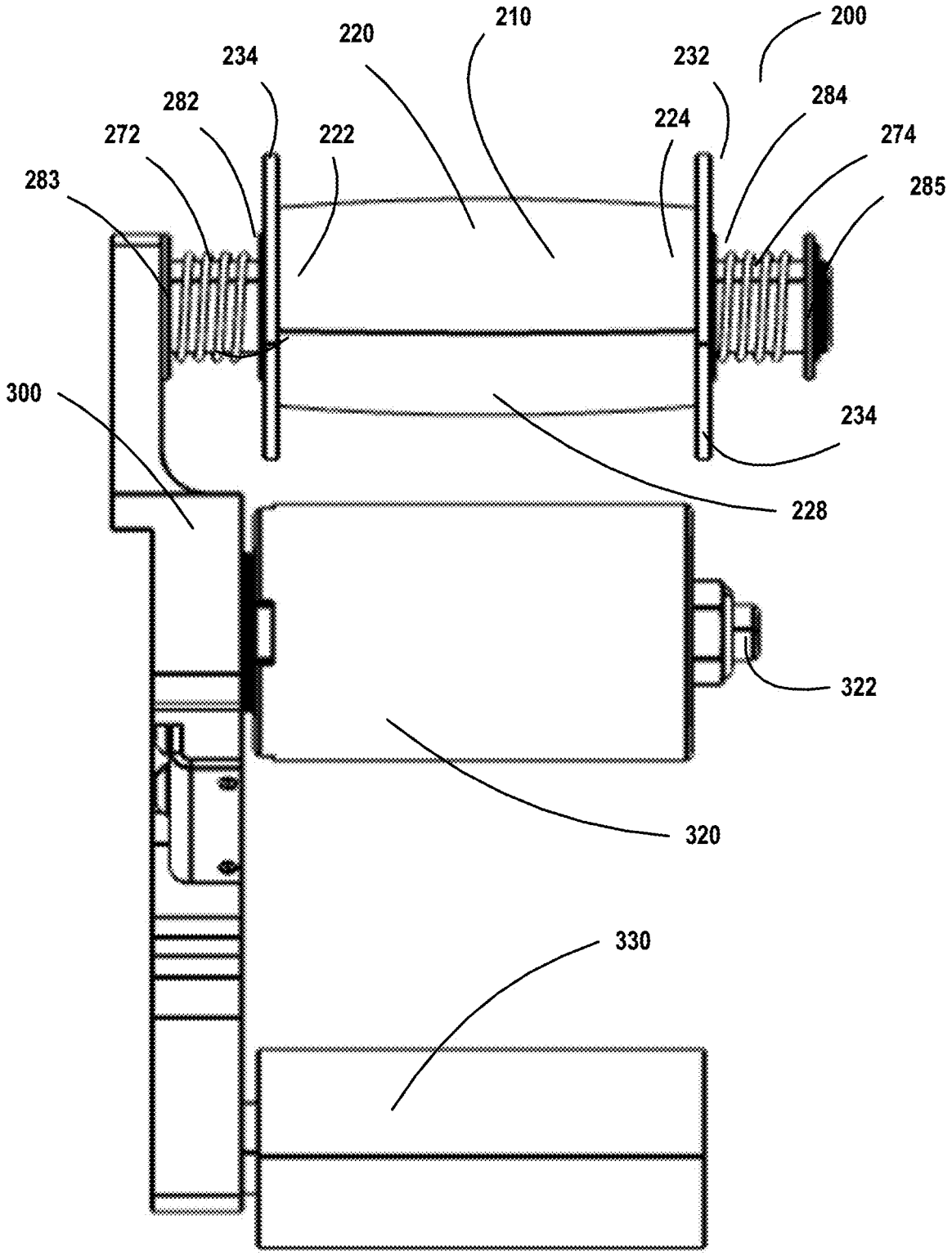
FIG. 10 is a rear view of an edge folder roller assembly, in accordance with embodiments of the present disclosure.
Figure 11:
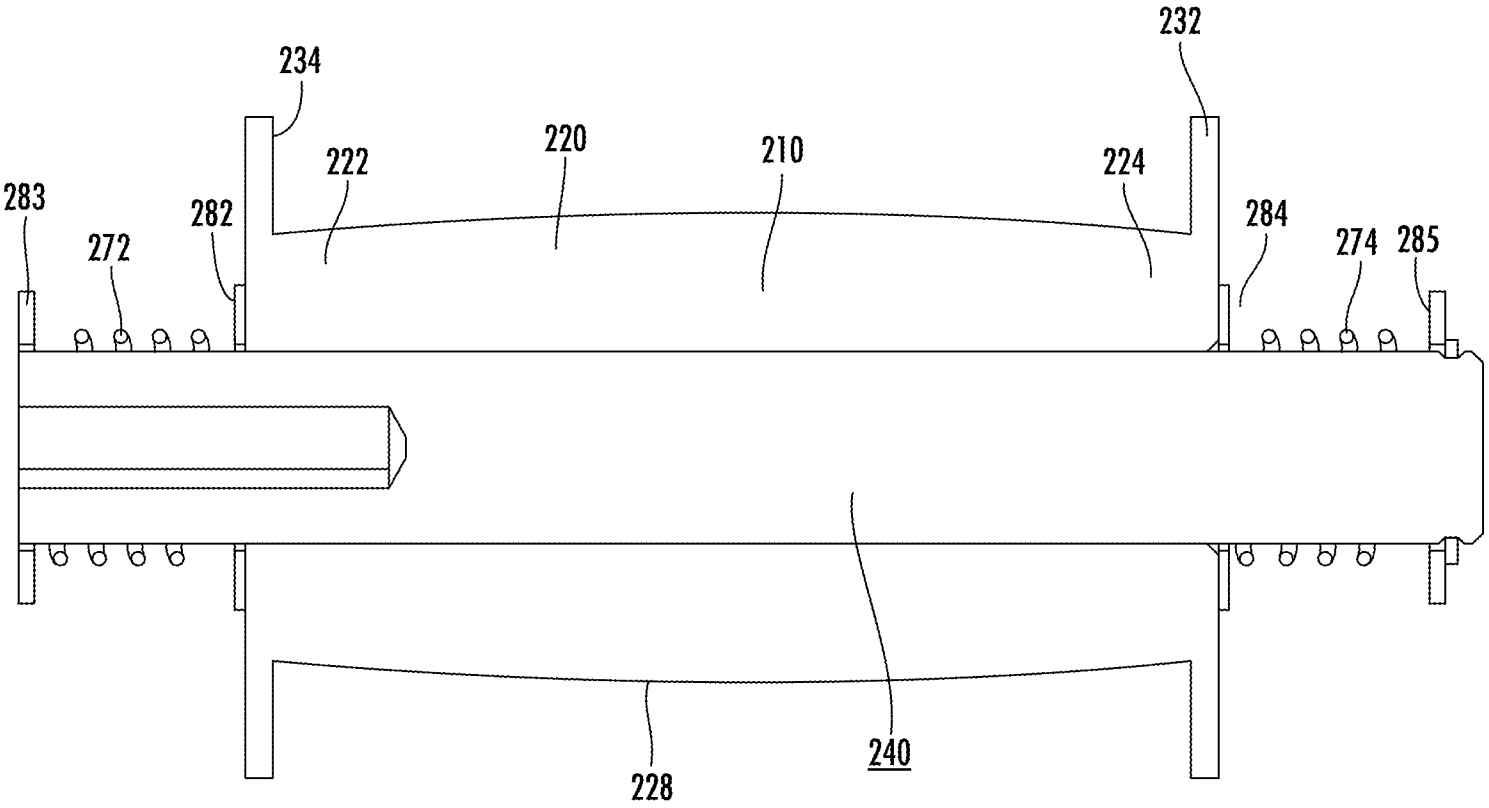
FIG. 11 is a cross-sectional view of the edge folder roller of the edge folder roller assembly, in accordance with embodiments of the present disclosure.

As further illustrated in FIGS. 6 and 10, the edge folder roller 210 may comprise an inner roller portion 220 and/or one or more outer projection portions 230. The one or more outer projection portions 230 may comprise a first outer projection 232 adjacent a first end 222 of the inner roller portion 220 and/or a second outer projection 234 adjacent a second end 224 of the inner roller portion 220. The inner roller portion 220 and/or the one or more outer projections 230 may be shaped to aid in folding one or more edges of the tape T. For example, the inner roller portion 220 may have a curved surface 228, such as, a curved surface extending from the middle 226 of the inner roller portion 220 to the first end 222 and/or the second end 224 of the inner roller portion 220 (e.g., the diameter of the inner roller portion may be larger in the middle and be reduced at the ends). In some embodiments, the one or more outer projection portions 230 may be curved inwardly towards the inner roller portion 220. The one or more curved surfaces may aid in directing the edge of the tape to be folded over (e.g., by creating a v-shaped pocket) such that the adhesive portions of the tape T may stick together as the edges of the tape T are folded back upon themselves. It should be understood that while the edge folder roller 210 may have the curved surfaces described herein, the edge folder roller 210 may have any type of shape (e.g., multiple curved surfaces, straight surfaces, or the like).

The edge folder assembly 200 may further have one or more mounting members 300, such as a mounting plate 302 (e.g., a clutch bracket, or the like) that is operatively coupled to the one or more edge roller shafts 240 and the tape applicator 100. The one or more mounting members 300 may be utilized to mount the components of the edge folder assembly to the tape applicator 100. Furthermore, the edge folder assembly 200 may comprise a tape recognition assembly 350 (e.g., proximity sensor, sensor mount, or the like) that is used to determine when no tape is identified, and thereafter send a notification signal.

The edge folder assembly 200 may be a stand-alone assembly or may further comprise one or more additional rollers, as illustrated in FIGS. 6 through 11. For example, the edge folder assembly 200 may further comprise a knurled roller 320, one or more guide rollers 330, or the like. The knurled roller 320 (e.g., otherwise described as a clutch roller) may be operatively coupled to the one or more mounting members 300 through a knurl support member 322 around which the knurl roller 320 may rotate. Moreover, a knurl bearing 324 may be utilized, such as a one way bearing, in order only allow the rotation of the knurled roller 320 in a single direction, such as a forward direction for moving the tape T downstream. As such, the knurl roller 320 may be prevented from rotating in a reverse direction in order to prevent the tape from recoiling back upstream towards the edge folder roller 210. The knurled roller 320 may also engage with the adhesive side of the tape T, which may also aid in restricting the tape from recoiling back upstream towards the edge folder roller 210. In some embodiments, the knurled roller 320 may have projections 326 (e.g., ridges, embossments, or the like) and/or a coating (e.g., a polytetrafluoroethylene (PTFE), or other like coating) that aids in preventing the adhesive side of the tape from adhering to the knurled roller 320.

The edge folder assembly 200 may further comprise one or more guide rollers 330 that may be operatively coupled to the one or more mounting members 300 through one or more guide support members 332 around which the guide roller 330 may rotate. The one or more guide rollers (e.g., edge folder guide rolls 330) may aid in moving the tape T downstream for application to a carton, as will be described in further detail herein.

Figure 5A:
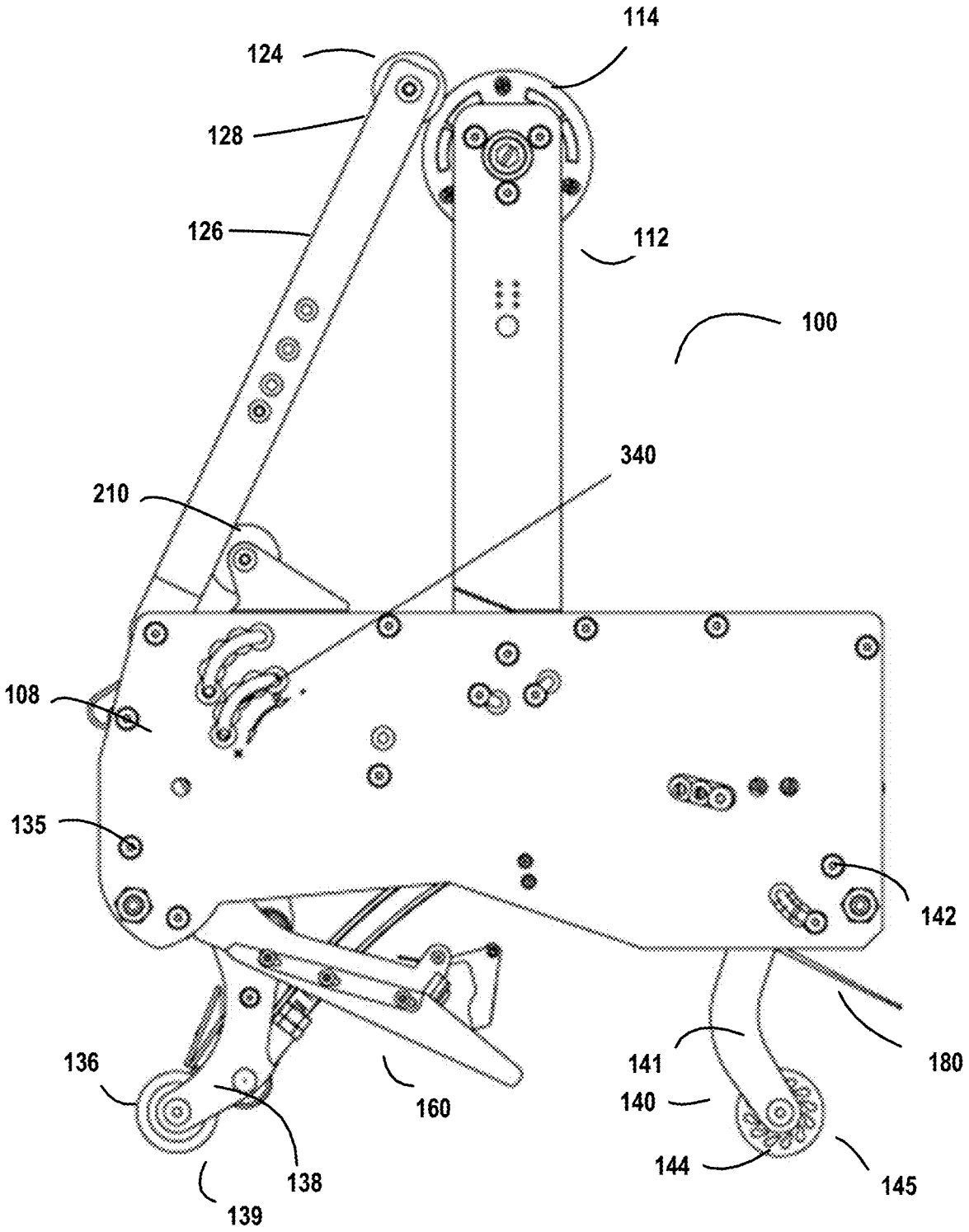
FIG. 5A is a second side view of a tape applicator for a carton sealing machine with a positioning adjustment for an edge folder roller assembly, in accordance with embodiments of the present disclosure.
Figure 5B:
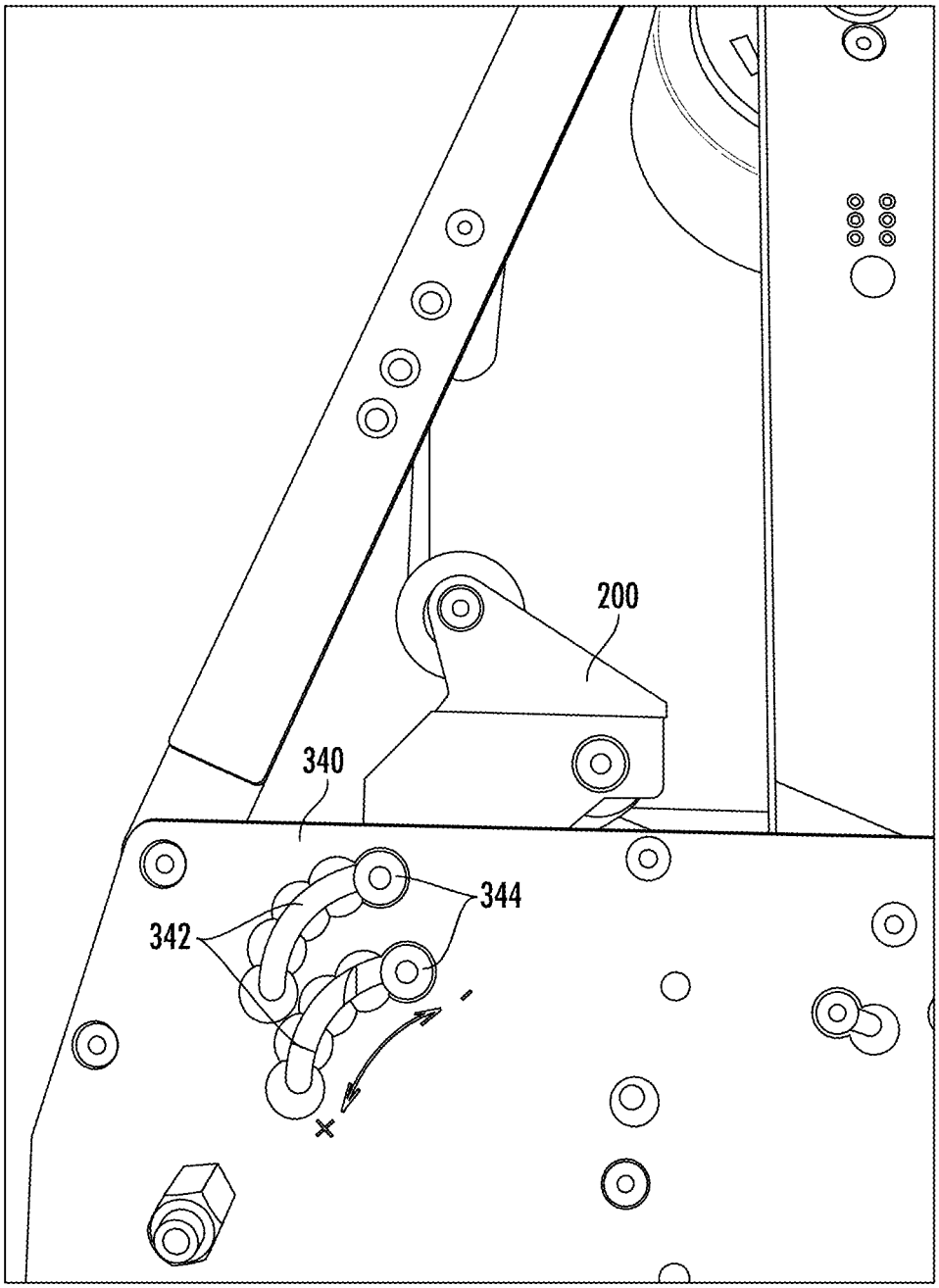
FIG. 5B is an enlarged view of a portion of FIG. 5A illustrating a second side view of the tape applicator with a positioning adjustment for an edge folder roller assembly, in accordance with embodiments of the present disclosure.

Moreover, in some embodiments the individual rollers and/or the entire edge folder assembly 200 may be adjustable with respect to the tape applicator 100 in order to set the tape leg length (e.g., the length of the tape that will extend over the edge and down the side of a carton). The guide roller 330 may actually set the tape leg length since it is the last roller in the edge folder assembly 200, as such the entire edge folder assembly 200 may be adjustable and/or in some embodiments only the last guide roller 330 is adjustable. As such, the edge roller assembly 200 may comprise a tape leg adjustment assembly 340. As illustrated in FIGS. 5A and 5B, the tape leg adjustment 340 may comprise one or more adjustment apertures 342 (e.g., slots, counter-sinks, or the like) extending through the frame (e.g., main frame 108) of the tape applicator 100. In some embodiments, the edge folder assembly 200 may be adjustable by positioning the edge folder assembly 200 in different positions within the one or more adjustment apertures 342. For example, couplings (e.g., fasteners 344, or the like) that operatively couple the edge folder assembly 200 (e.g., the mounting plate 302, or the like) to the frame (e.g., the main frame 108) may be decoupled (e.g., loosened, or the like) and recoupled (e.g., tightened, or the like) in a different position. As such, the tape leg adjustment 340 may allow a user to set the tape leg length (e.g., through the main frame 108 and/or cover 109). While embodiments of the tape leg adjustment 340 are specifically illustrated in the figures, it should be understood that other types of tape leg adjustments 340 may be utilized in order to move the edge folder assembly 200 and/or the guide roller 330 in order to set the tape leg length. The tape leg length may vary between 1 and 3 inches, 2 to 3 inches, or the like (or range within, overlap, or fall outside of this range). Longer tape leg lengths may be set to provide a more secure seal to the carton, while shorter tape leg lengths may be set if the carton is shallow to prevent the top and/or bottom tape legs from overlapping and/or extending past the side of the carton.

Figure 2:
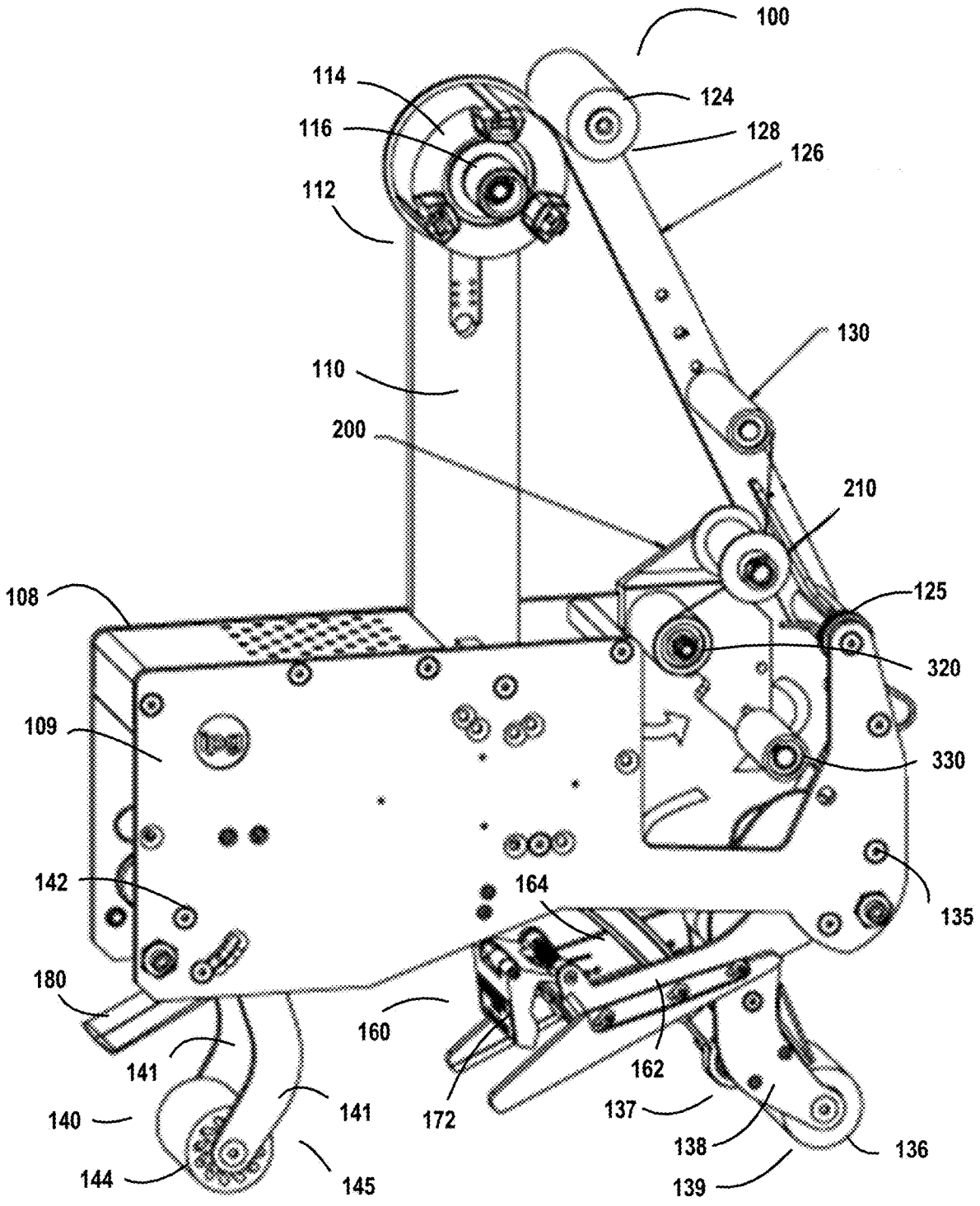
FIG. 2 is a perspective side view of a tape applicator for a carton sealing machine, in accordance with embodiments of the present disclosure.
Figure 3A:
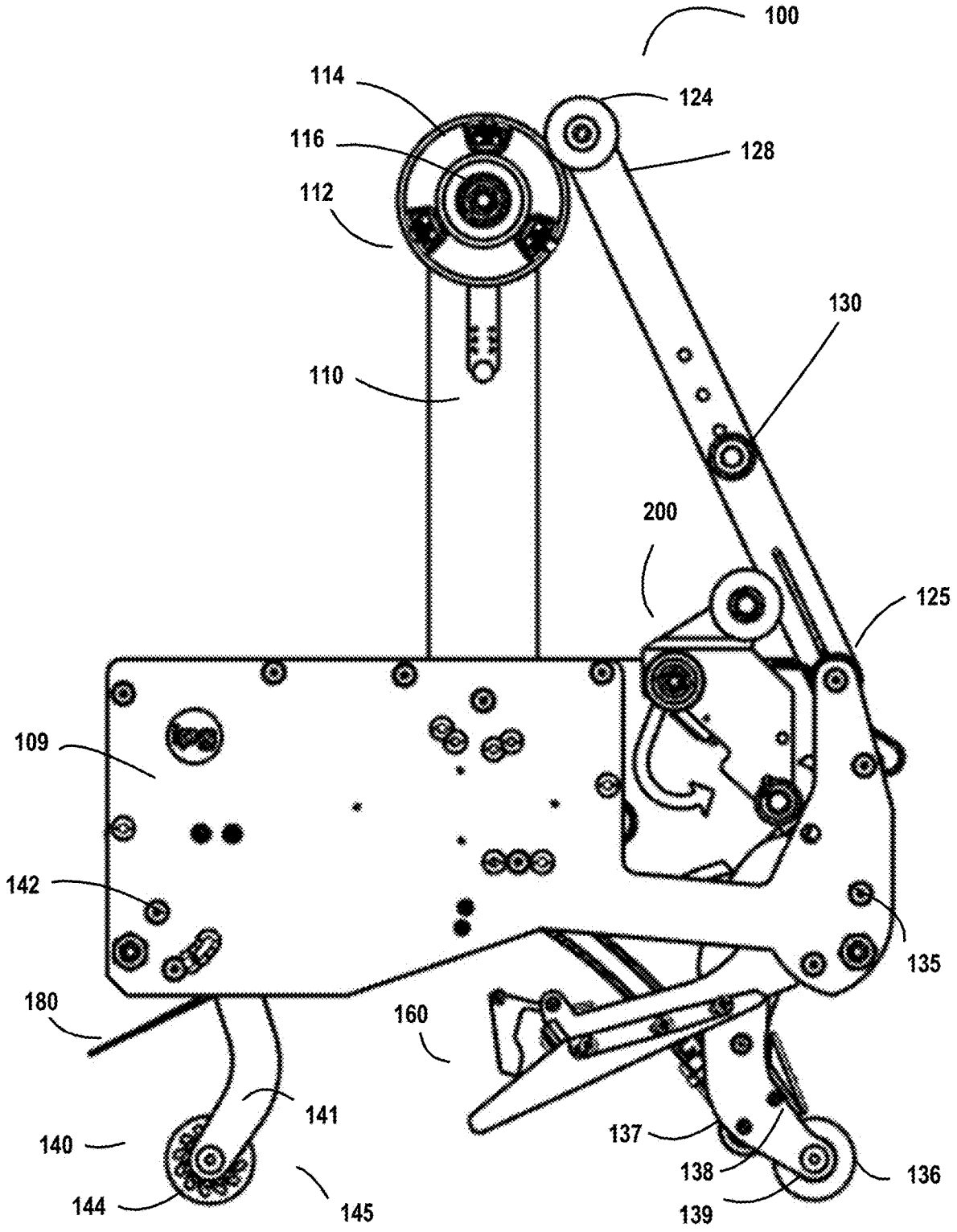
FIG. 3A is a first side view of a tape applicator for a carton sealing machine with an edge folder roller assembly, in accordance with embodiments of the present disclosure.

As the tape T exits the edge folder assembly 200, the tape T may be moved to a front applicator roll 136 that applies a leading end of the tape T to a carton that is to be taped. In the illustrated tape applicator 100, the front applicator roll 136 and the tape guide (or front applicator guide rolls, in an alternate embodiments) are mounted on a front applicator arm 137, including opposing side arms 138 pivotally mounted to the main frame 108 as indicated in FIGS. 2, 3, and 5. The front applicator roll 136 may be rotatably mounted on the front applicator arm 137 proximate its free end 139 remote from the pivotal mount 135. It will be appreciated that various additional and/or alternative roller configurations may be implemented for directing the tape from a dispensing roll 120 and/or the edge folder assembly 200 and orienting the tape T for application to a carton.

Figure 3B:
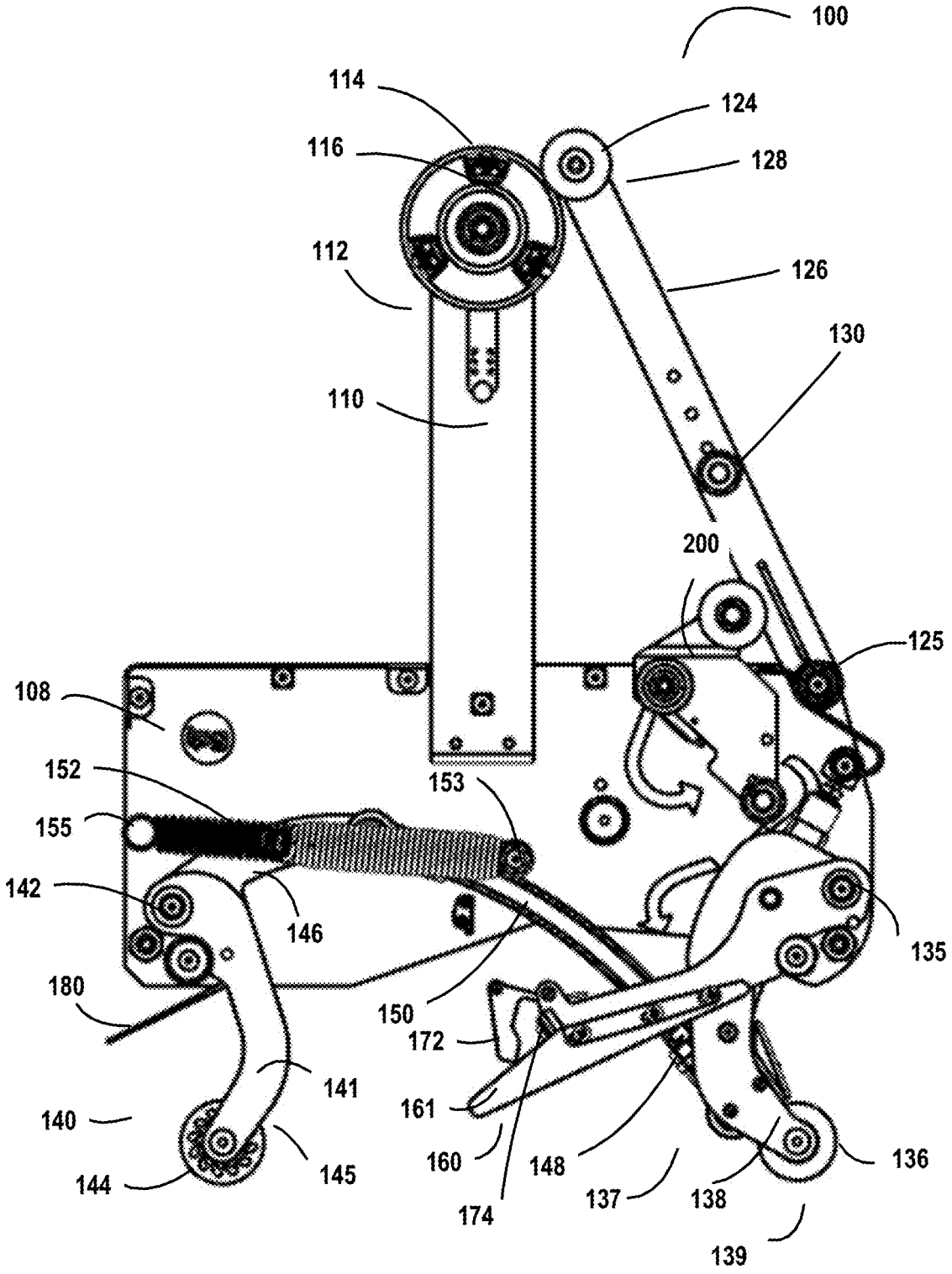
FIG. 3B is a first side view of a tape applicator for a carton sealing machine with a cover removed, in accordance with embodiments of the present disclosure.
Figure 4:
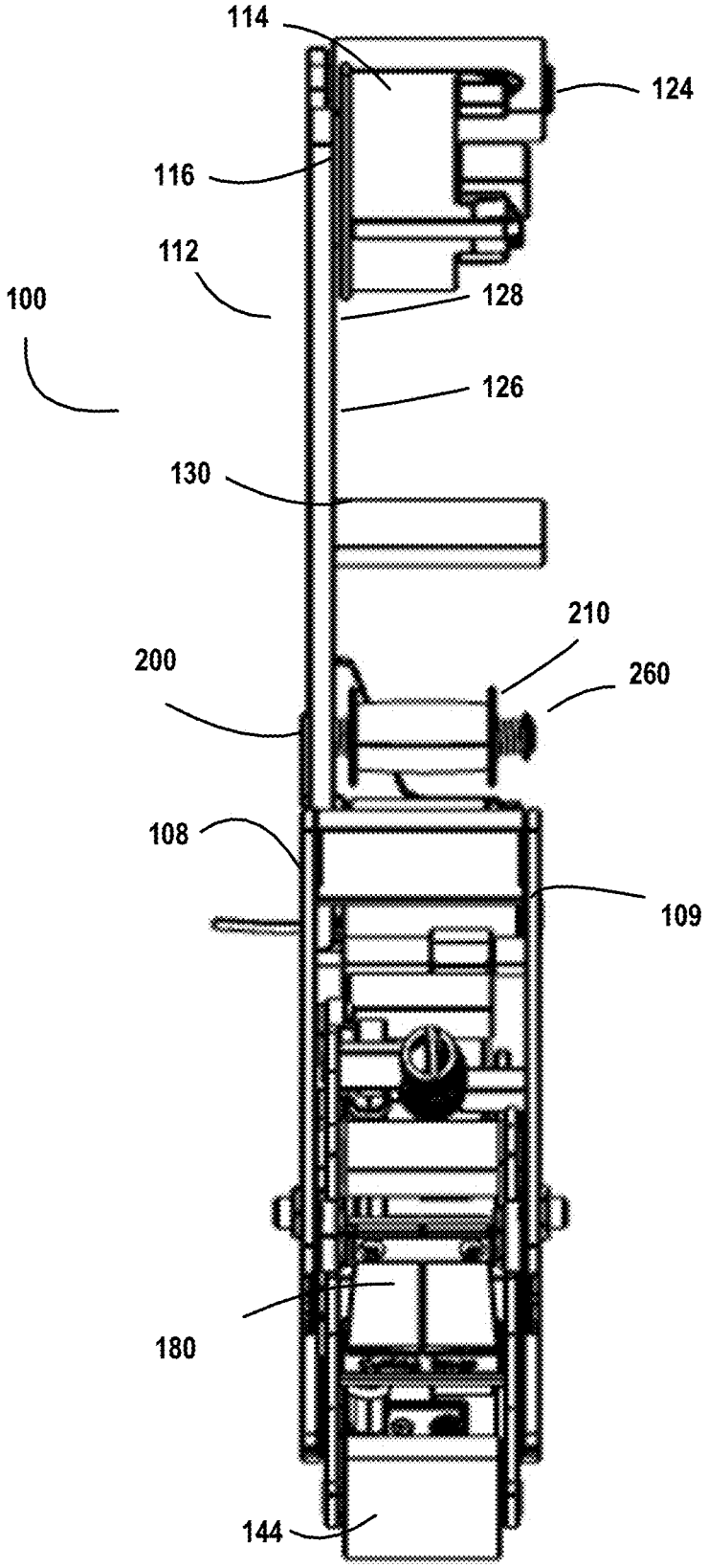
FIG. 4 is a rear view of a tape applicator for a carton sealing machine with an edge folder roller assembly, in accordance with embodiments of the present disclosure.

Continuing with the illustrated tape applicator 100, a rear applicator arm 140, including opposing side arms 141, may be pivotably mounted to the main frame 108 on pivot mount 142. A rear applicator roll 144 may be rotatably mounted on the rear applicator arm 140 proximate its free end 145 remote from the pivotal mount 142. Moreover, as illustrated in FIG. 3B, a push bar 146 and/or the rear applicator arm 140 may be mounted on a pivot mount 142 proximate the rear of the tape head 100, and a first end 148 of the push bar 146 may be operatively coupled to the front applicator arm 137 by linkage 150. A main spring 152 may extend generally parallel to the main frame 108 and may be operatively coupled to the main frame 108 and/or the cover frame 109 at a second end 155 (e.g., second loop or rear loop) and to the push bar 146 and/or linkage 150 at a first end 153 (e.g., first loop or front loop) thereof to bias the front and rear applicator arms 137, 140 in concert to a receiving position ready to receive the next carton or box to be taped. The movement of the front and rear applicator arms 137, 140 may be limited by the presence of a stop (not illustrated), such as a rear bumper positioned proximate the rear applicator arm 140. A wiper 180 (e.g., brush, flexible, or the like) may be operatively coupled to any support member (e.g., frame, bar, plate, coupling, face, cover, or the like) of the tape applicator 100. In some embodiments, the wiper 180 may be positioned downstream of the rear applicator arm 140; however, it should be understood that the wiper 180 (or a portion thereof) may be located downstream and/or upstream of the front applicator arm 137 and/or the rear applicator arm 140.

The tape applicator 100 may further include a blade for cutting a tape T applied to a carton, and a magnetically actuated blade guard for selectively exposing and covering or protecting the blade. The knife arm assembly 160 may include parallel side plates 162 and 164, defining a knife arm 161. The parallel side plates 162, 164 may act as arm extensions (or may include arm extensions) to set the timing of the swing of the knife arm 160, and thus, when the tape is cut. It should be understood that the side plates 162, 164 and/or arm extensions may be separate parts or may be integral parts. The side plates 162, 164 may be connected by one or more shafts. Additionally, the side plates 162, 164 may be connected to one another, and to the main frame 108 by a pivotal mount 135, proximate the respective front ends of the side plates 162, 164, as illustrated in FIGS. 2, 3, and 5. The pivotal mount 135 may rotatably operatively couple the side plates 162, 164 to the main frame 108 and/or the cover frame 109. The side plates 162, 164 may be spaced apart from one another to receive tape T therebetween. In particular, the tape T may be received between the side plates 162, 164 after the tape T has been applied to a carton by the front application roll 136. The movement of the knife arm assembly 160 (e.g., pivotal movement relative to the main frame 108) may be limited by a stop, such as front bumper. Consistent with the illustrative embodiment, the one or more shafts may also support a spring that may bias a blade guard 172 to a closed position over a blade 174. In such an arrangement, both the guard 172 and the blade 174 pivotally move with the knife arm assembly 160 relative to the main frame 108.

During a taping process, a carton may move under (or over) the tape head 100 (e.g., via a suitable conveyer, roller, or other feed mechanism). During such a taping process, the knife arm 161 may be biased away from the main frame 108, and into contact with the carton being taped. Accordingly, as the carton is fed pass the tape applicator 100, the knife arm 161 may be pushed toward a position adjacent to the main frame 108 by the carton. As the carton passes 161 the tape head, the knife arm 161 may no longer be in contact with the carton, and the biasing force and the knife arm 161 may cause the knife arm 161 to rotate to a position further away from the main frame 108 (e.g., further away from the main frame 108 than when the carton was restricting rotational movement of the knife arm 161) and to cut the tape T. The process may be repeated for subsequent cartons.

While specific embodiments of a tape applicator 100 are illustrated and discussed above, it should be understood that the edge folding roller assembly 200, and the components thereof, described herein may be utilized with any type of tape applicator that is automated, or manual, and/or any of the tape applicator components described herein.

Figure 12A:
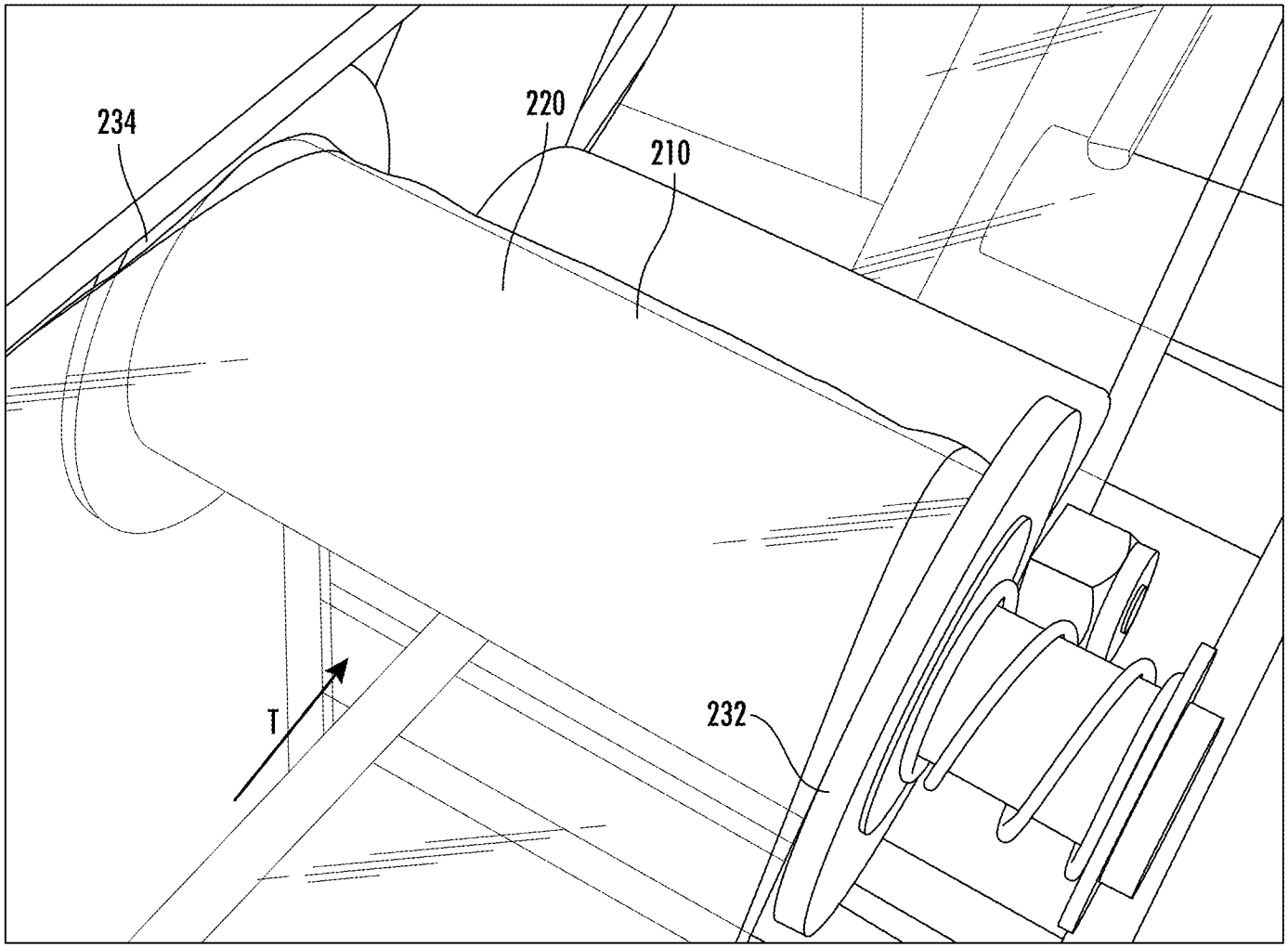
FIG. 12A is a perspective view of a portion of an edge folder roller assembly in operation for folding the edges of tape, in accordance with embodiments of the present disclosure.
Figure 13A:
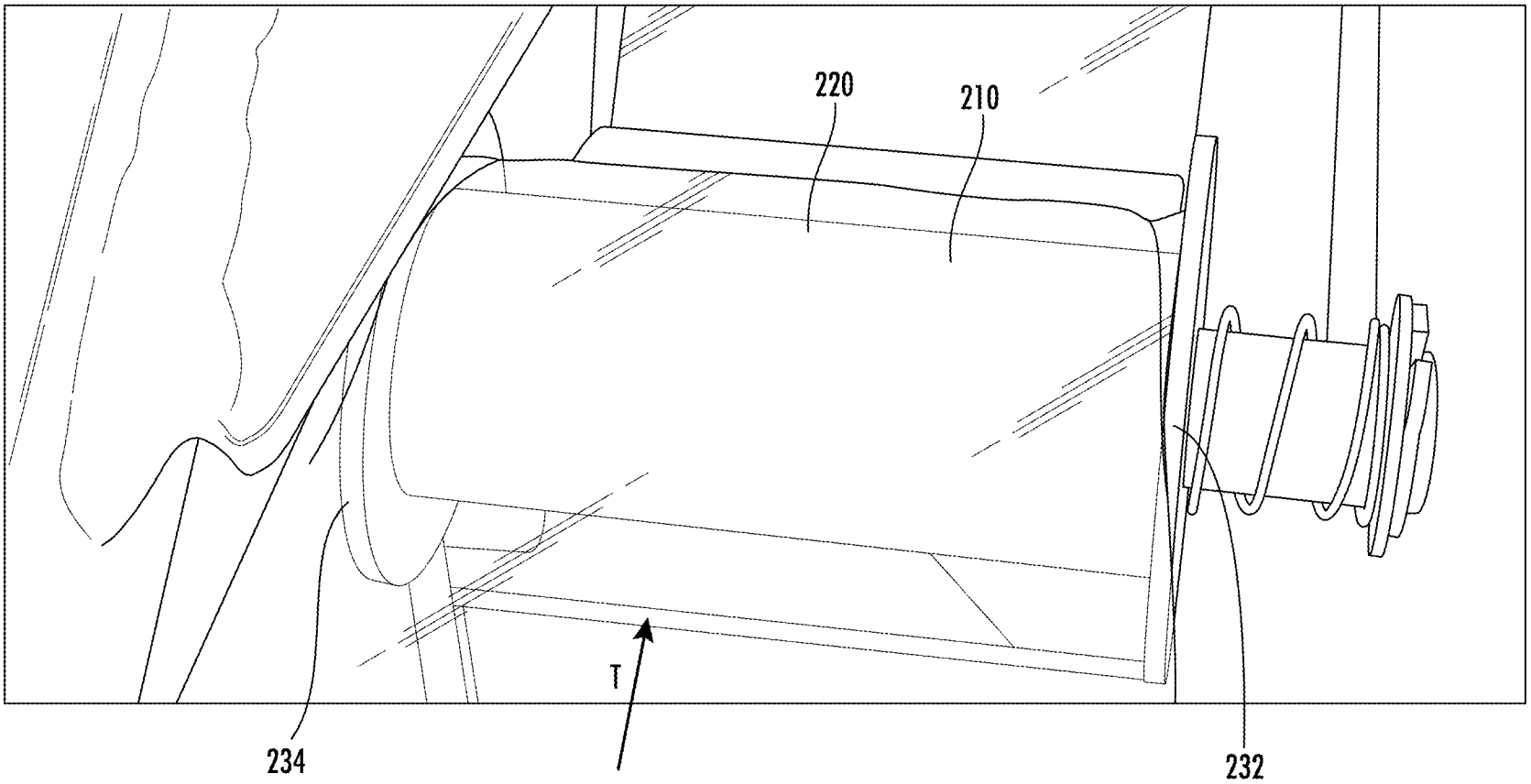
FIG. 13A is a perspective view of an edge folder roller assembly having an edge folder roller in the home position, in accordance with embodiments of the present disclosure.
Figure 13B:
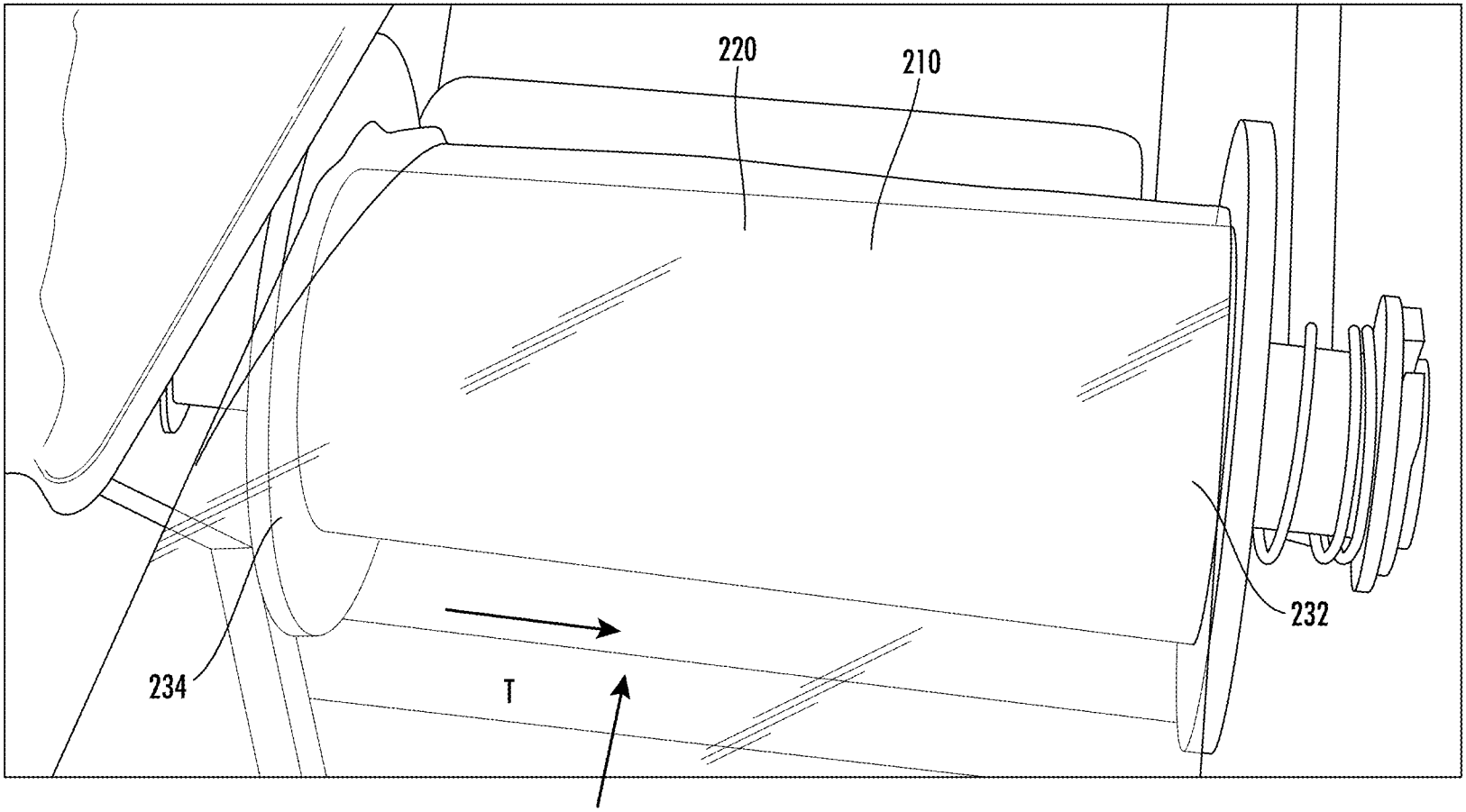
FIG. 13B is a perspective view of an edge folder roller assembly having an edge folder roller moved axially with respect to a support member, in accordance with embodiments of the present disclosure.
Figure 13C:
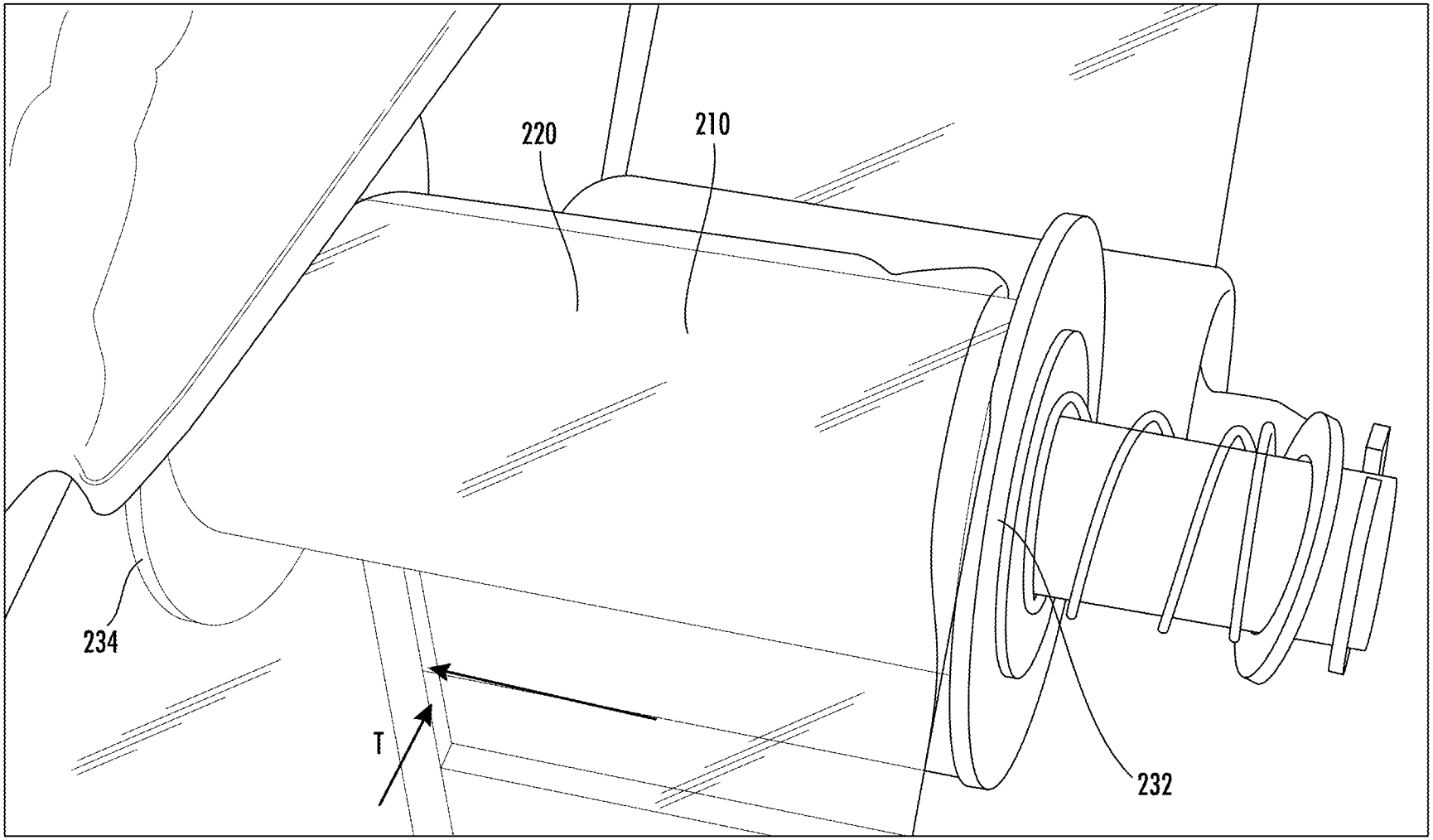
FIG. 13C is a perspective view of an edge folder roller having an edge folder roller moved axially with respect to a support member, in accordance with embodiments of the present disclosure.
Figure 14:
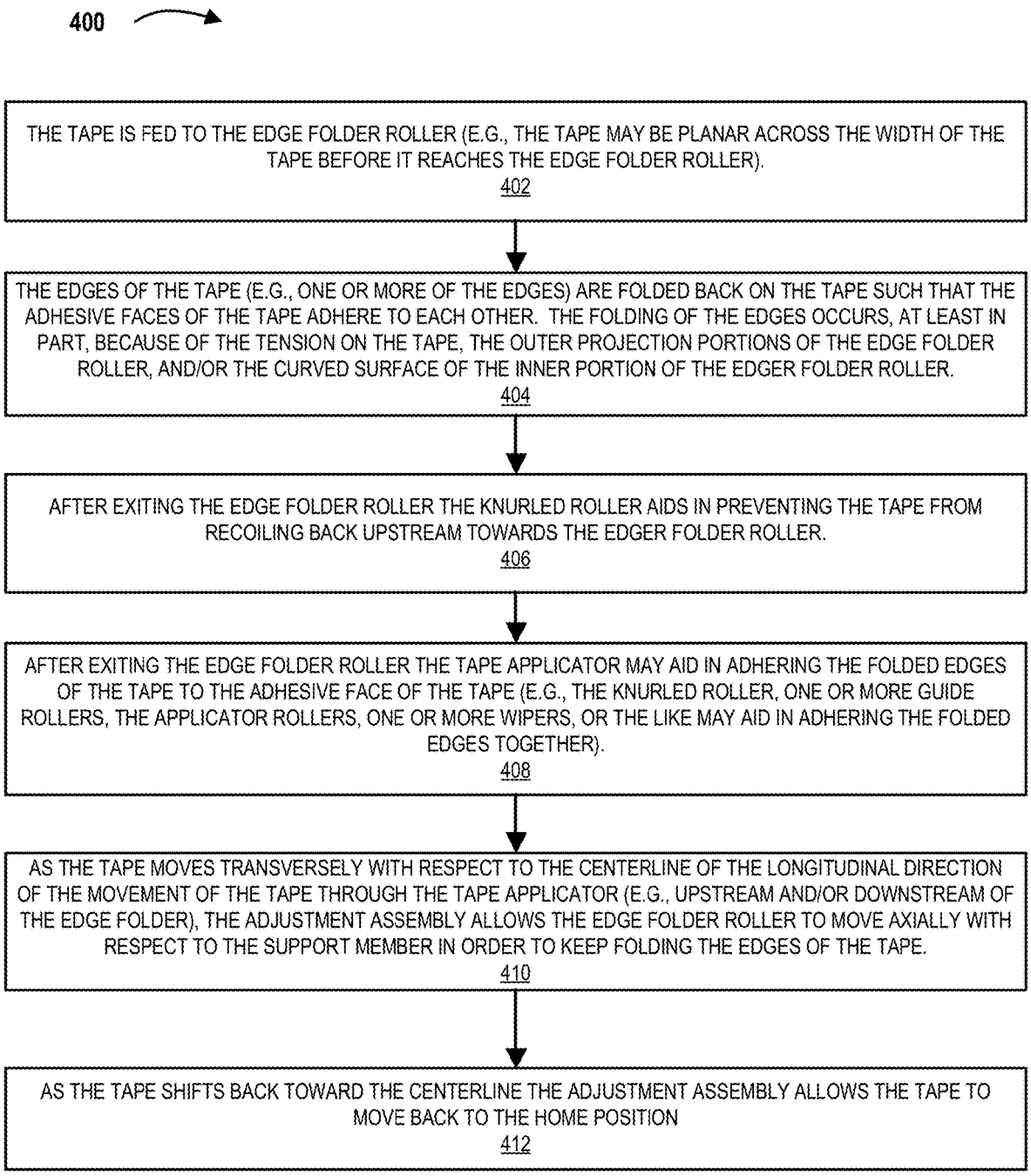
FIG. 14 is a method of operation of the edge folder rolling assembly, in accordance with embodiments of the present disclosure.

FIG. 14 illustrates a process 400 for folding the edges of tape using the edge folder assembly 200 described herein. Furthermore, FIGS. 12A to 13C illustrate embodiments of the edge folder assembly 200 in operation during the edge folding process. As illustrated by block 402 in FIG. 12, and in FIGS. 12A and 12B, the edge folder roller 210 receives the tape T in tension. As illustrated in FIG. 12A, the tape T may be planar and flat across its entire width as the tape enters the edge folder roller 210. The outer projection portions 230 of the edge folder roller 210 may sit inside the width of the tape T, which as discussed will aid in the edge folding process.

Figure 12B:
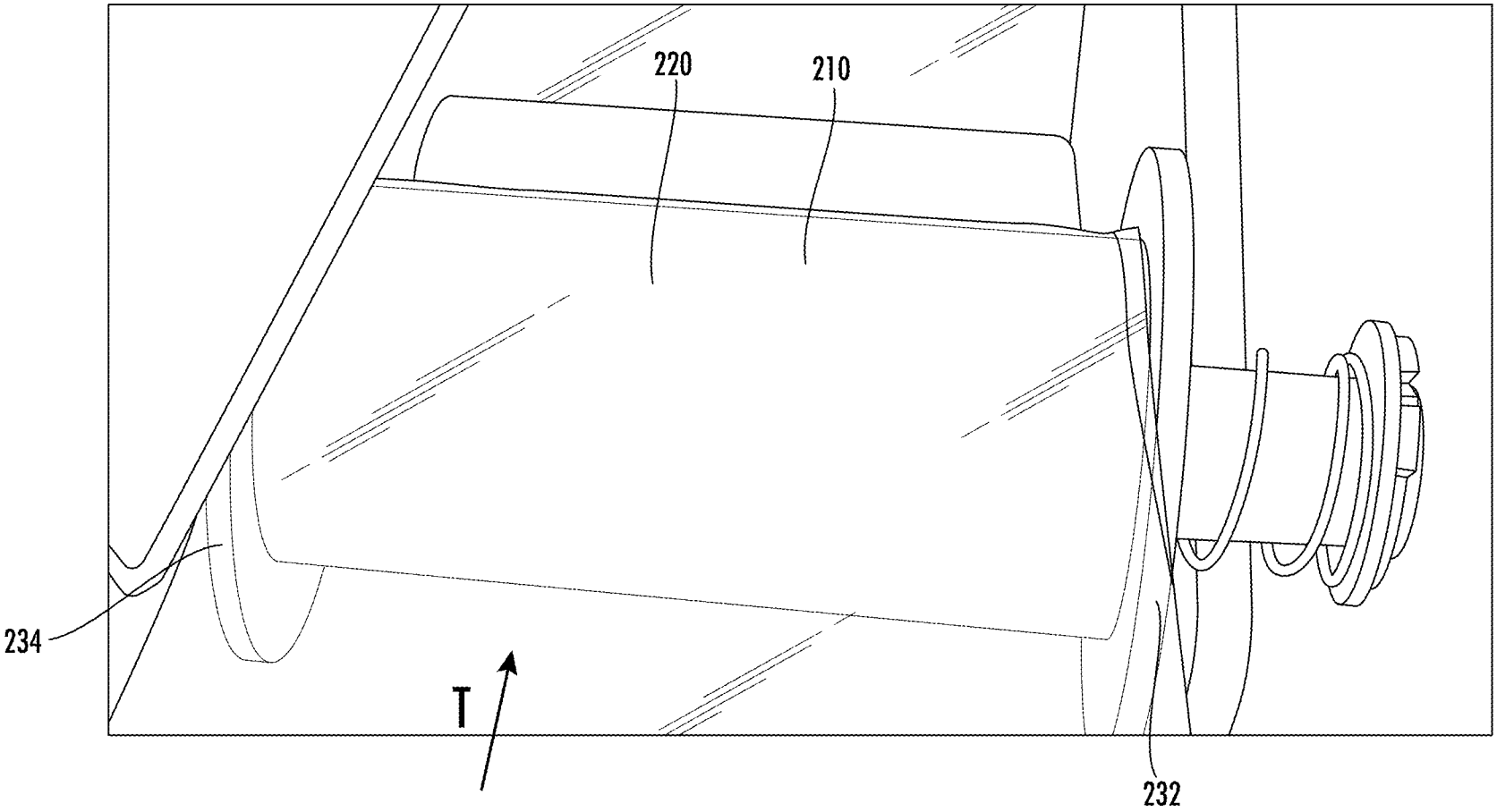
FIG. 12B is a perspective view of a portion of an edge folder roller assembly in operation for folding the edges of tape, in accordance with embodiments of the present disclosure.

As further illustrated by block 404 of the process flow of FIG. 14 and FIGS. 12A and 12B, due to the tension on the tape T, the outer projection portions 230, and/or the curved surface 228 of the inner portion 220 of the edge folder roller 210, the edges of the tape T are curled over and folded back on the tape T such that the adhesive on the edges and the tape adhere to each other. As the tape T is tensioned over the edge folder roller 210, the edge folder roller 210 rotates with respect to the one or more support members 240 in order to move the tape T through the edge folder roller assembly 200 and continue folding unfolded edges of the tape T.

Figure 12C:
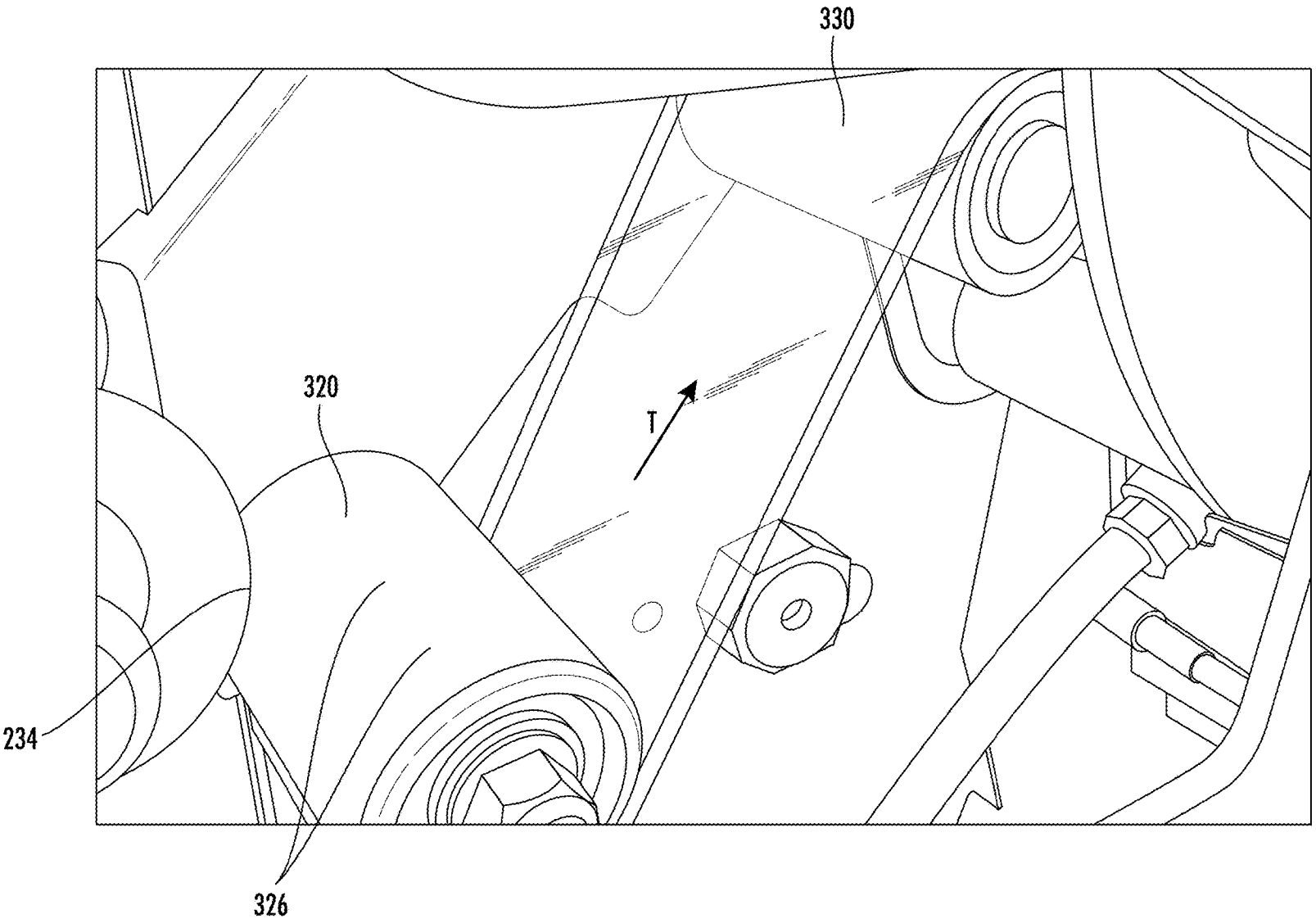
FIG. 12C is a perspective view of a portion of an edge folder roller assembly in operation for folding the edges of tape, in accordance with embodiments of the present disclosure.
Figure 12D:
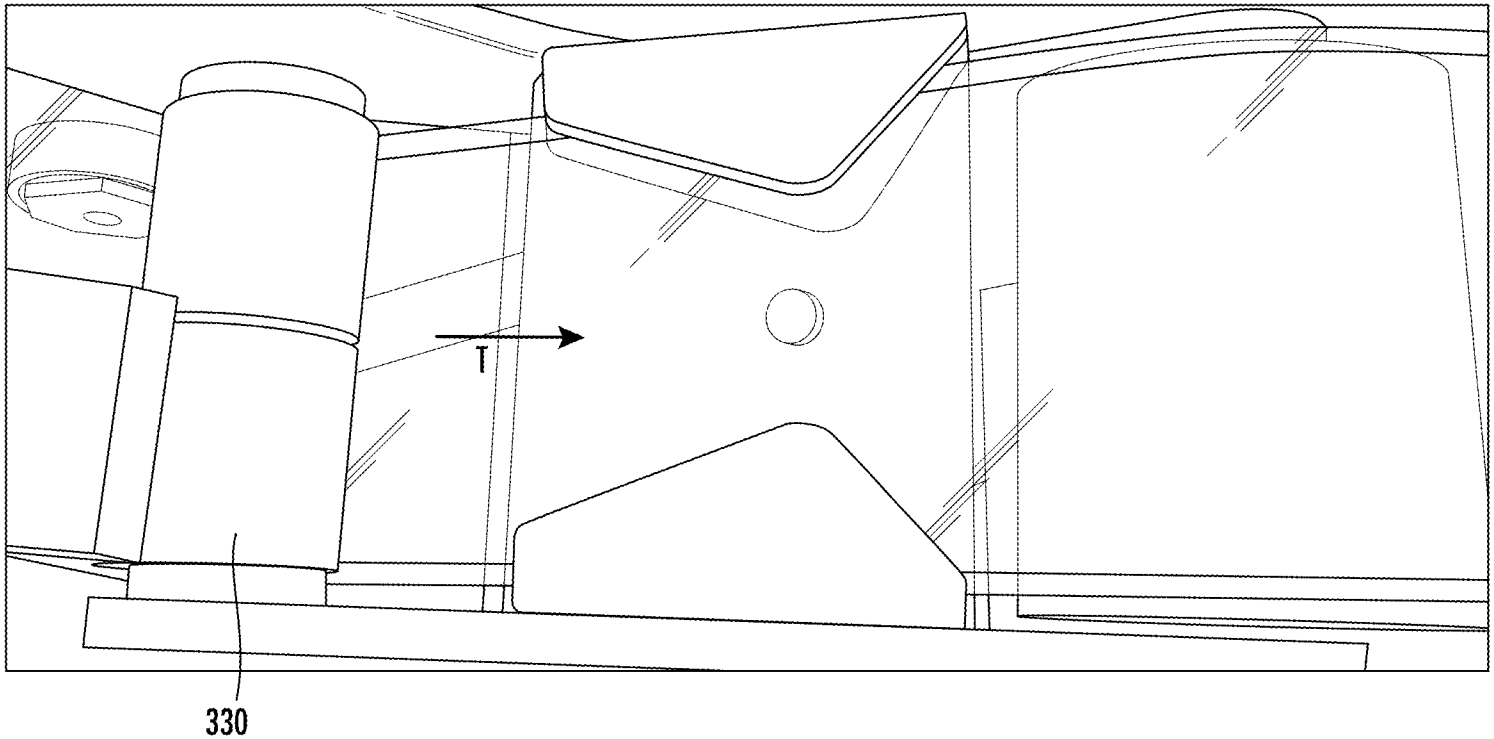
FIG. 12D is a perspective view of a portion of the tape applicator downstream of an edge folder roller assembly in operation, in accordance with embodiments of the present disclosure.

As further illustrated in block 406 of FIG. 14 and FIGS. 12C and 12D, after exiting the edge folder roller 210, the tape T may pass to one or more additional rollers, such as, but not limited to the knurled roller 320. The knurled roller may aid in preventing tape T that is not applied to a carton from moving back upstream after the tape T that is applied to the carton is cut. That is, the one-way barring and/or the engagement of the adhesive face of the tape with the knurled roller 320 (e.g., the projections 326 of the knurled roller 320) may restrict the tape T from recoiling towards and/or bunching up at the edge folder roller 210.

As illustrated further in block 408 and FIGS. 12C and 12D, after the tape T leaves the edge folder roller 210 the tape applicator 100 may aid in adhering the folded edges of the tape to the adhesive face of the tape T. In some embodiments, the tension in the tape itself T and/or the additional rollers 320, 330 in the edge folder assembly 100 will aid in making sure the folded edge of the tape adheres to itself. In still other embodiments, the applicator rollers (e.g., front applicator roller 136, rear applicator roller 144, or the like) and/or one or more wipers 180 (e.g., brush wiper, sled wiper, flexible wiper 180, or the like) that apply the tape T to the carton will aid in making sure the folded edges of the tape T adhere to each other by pressing down on the folded edges as the tape T is being applied to a carton. As such, in some instances bubbles and/or creases in the folded edges of the tape T will be flattened as the tape T runs through the tape applicator 100 and/or is applied to a carton. However, it should be understood that in some embodiments, one or more edge members (not illustrated), such as a bracket edge, roller edges (e.g., one or more pressure rollers), or the like may be operatively coupled within the edge folder assembly 200 and/or after the edge folder assembly 200. The edge members may be utilized to aid in applying pressure to the folded edges of the tape T in order to aid in adhering the folded edges of the tape to the adhesive face of the tape T. However, in some embodiments, it should be understood that the edge folder roller 210 may be all that is needed in order to fold the edges of the tape T back on itself.

Blocks 410 and 412 of FIG. 14 and FIGS. 13A through 13C, illustrate that the adjustment assembly 260 of the edge folder roller assembly 200 allows for shifting of the tape transversely with respect to the centerline of the longitudinal direction of the tape through the tape applicator 100. As illustrated in FIG. 13A, during normal operation, the one or more biasing members 280 of the adjustment assembly 260 may position the edge folder roller 210 in the home position (e.g., centerline position, or the like). FIG. 13B illustrates that when the tape T shifts transversely in the tape applicator 100 (e.g., outwardly in a first direction with respect to the longitudinal movement of the tape T), it may exert a force on the edge folder roller 210, and in response the edge folder roller 210 may shift axially with respect to the one or more support members 240 to one or more first offset positions. However, the edge folder roller 210 may still fold the edges of the tape and return back to the home position when the tape shifts back to the home position (e.g., at the centerline, or the like). Moreover, FIG. 13C illustrates that when the tape T shifts transversely in the tape applicator 100 in the opposite direction (e.g., inwardly in a second direction with respect to the longitudinal movement of the tape T), it may exert a force on the edge folder roller 210, and in response the edge folder roller 210 may shift axially with respect to the one or more support members 240 to one or more second offset positions. Again, the edge folder roller 210 may still fold the edges of the tape T and return back to the home position when the tape shifts back to the home position (e.g., at the center line, or the like).

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more.

Certain terminology is used herein for convenience only and is not to be taken as a limiting unless such terminology is specifically described herein for specific embodiments. For example, words such as "top", "bottom", "upper", "lower", "first", "second", "inner", "outer", or the like may merely describe the configurations shown in the Figures and described herein for some embodiments of the invention. Indeed, the components may be oriented in any direction and the terminology, therefore, should be understood as encompassing such variations unless specified otherwise. The terminology includes the words specifically mentioned above, derivatives thereof and words of similar import.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed:

1. An edge folder roller assembly comprising:

one or more roller support members;

an edge folder roller operatively coupled to the one or more roller support members to allow rotation of the edge folder roller with respect to the one or more roller support members, wherein the edge folder roller comprises an inner portion and one or more outer projections; and an alignment assembly operatively coupled to the edge folder roller or the one or more roller support members, wherein the alignment assembly allows the edge folder roller to move axially with respect to the one or more roller support members;

wherein the edge folder roller receives tape and the one or more outer projections folds at least one edge of the tape as the tape moves over the edge folder roller.

2. The edge folder roller assembly of claim 1, wherein the one or more outer projections comprise:

a first outer projection adjacent a first end of the inner portion; and a second outer projection adjacent a second end of the inner portion;

wherein the first outer projection folds a first edge of the tape and the second outer projection folds a second edge of the tape.

3. The edge folder roller assembly of claim 2, wherein the inner portion comprises an inner portion surface, and wherein the inner portion surface is a convex surface.

4. The edge folder roller assembly of claim 2, wherein the one or more outer projections have an inner projection surface and an outer projection surface, and wherein the inner projection surface is a concave surface.

5. The edge folder roller assembly of claim 1, wherein the alignment assembly comprises:

one or more biasing members operatively coupled adjacent a first end or a second end of the edge folder roller.

6. The edge folder roller assembly of claim 5, wherein the one or more biasing members comprises:

a first biasing member operatively coupled adjacent the first end of the edge folder roller;

a second biasing member operatively coupled adjacent the second end of the edge folder roller;

wherein the first biasing member and the second biasing member are operatively coupled to the one or more roller support members; and wherein the first biasing member and the second biasing member allow the edge folder roller to move axially with respect to the one or more roller support members.

7. The edge folder roller assembly of claim 5, wherein the one or more biasing members are springs.

8. The edge folder roller assembly of claim 5, wherein the alignment assembly further comprises:

one or more restraining members operatively coupled to the one or more biasing members, wherein the one or more restraining members aid in allowing the one or more biasing members to align the edge folder roller.

9. The edge folder roller assembly of claim 8, wherein the one or more restraining members comprise:

one or more first restraining members operatively coupled to a first biasing member; and one or more second restraining members operatively coupled to a second biasing member.

10. The edge folder roller assembly of claim 1, further comprising:

a mounting member operatively coupled to the one or more roller support members.

11. The edge folder roller assembly of claim 10, further comprising:

a knurl roller operatively coupled to the mounting member, wherein the knurl roller only rotates in the forward direction to allow the tape to move downstream and aid in preventing the tape from moving upstream.

12. The edge folder roller assembly of claim 10, further comprising:

one or more guide rollers operatively coupled to the mounting member, wherein the one or more guide rollers aid in moving the tape downstream and setting a leg length of the tape.

13. A tape applicator, comprising:

an edge folder roller assembly, comprising:

one or more roller support members; and an edge folder roller operatively coupled to the one or more roller support members to allow rotation of the edge folder roller with respect to the one or more roller support members, wherein the edge folder roller comprises:

an inner portion;

one or more outer projections; and an alignment assembly operatively coupled to the edge folder roller or the one or more roller support members, wherein the alignment assembly allows the edge folder roller to move axially with respect to the one or more roller support members; and wherein the edge folder roller receives tape and the one or more outer projections fold at least one edge of the tape as the tape moves over the edge folder roller before the tape applicator applies the tape to a carton.

14. The tape applicator of claim 13, wherein the one or more outer projections comprise:

a first outer projection adjacent a first end of the inner portion; and a second outer projection adjacent a second end of the inner portion;

wherein the first outer projection folds a first edge of the tape and the second outer projection folds a second edge of the tape.

15. The tape applicator of claim 13, wherein the alignment assembly comprises:

one or more biasing members operatively coupled adjacent a first end or a second end of the edge folder roller.

16. The tape applicator of claim 15, wherein the alignment assembly further comprises:

one or more restraining members operatively coupled to the one or more biasing members, wherein the one or more restraining members aid in allowing the one or more biasing members to align the edge folder roller.

17. A method of folding an edge of tape, the method comprising:

receiving tape in an edge folder roller assembly, wherein the edge folder roller assembly comprises:

one or more roller support members; and an edge folder roller operatively coupled to the one or more roller support members, wherein the edge folder roller comprises an inner portion and one or more outer projections; and folding one or more edges of the tape with the one or more outer projections as the tape moves longitudinally over the edge folder roller and the edge folder roller rotates with respect to the one or more roller support members;

moving the edge folder roller axially with respect to the one or more roller support members as the tape moves laterally with respect to the one or more roller support members during operation of the edge folder roller assembly as the tape is moving longitudinally over the edge folder roller.

18. An edge folder roller assembly comprising:

one or more roller support members; and an edge folder roller operatively coupled to the one or more roller support members to allow rotation of the edge folder roller with respect to the one or more roller support members, wherein the edge folder roller comprises:

an inner portion comprising an inner portion surface, wherein the inner portion surface is a convex surface;

a first outer projection adjacent a first end of the inner portion; and a second outer projection adjacent a second end of the inner portion;

wherein the edge folder roller receives tape, and wherein the first outer projection folds a first edge of the tape and the second outer projection folds a second edge of the tape.

19. A method of folding an edge of tape, the method comprising:

receiving tape in an edge folder roller assembly, wherein the edge folder roller assembly comprises:

one or more roller support members; and an edge folder roller operatively coupled to the one or more roller support members to allow rotation of the edge folder roller with respect to the one or more roller support members, wherein the edge folder roller comprises:

an inner portion comprising an inner portion surface, wherein the inner portion surface is a convex surface;

a first outer projection adjacent a first end of the inner portion; and a second outer projection adjacent a second end of the inner portion;

folding a first edge of the tape using the first outer projection and a second edge of the tape using the second outer projection as the tape moves longitudinally over the edge folder roller and the edge folder roller rotates with respect to the one or more roller support members.

20. An edge folder roller assembly comprising:

one or more roller support members; and an edge folder roller operatively coupled to the one or more roller support members to allow rotation of the edge folder roller with respect to the one or more roller support members, wherein the edge folder roller comprises:

an inner portion;

a first outer projection adjacent a first end of the inner portion; and a second outer projection adjacent a second end of the inner portion;

wherein the first outer projection and the second outer projection have an inner projection surface and an outer projection surface, and wherein the inner projection surface is a concave surface;

wherein the edge folder roller receives tape, and wherein the first outer projection folds a first edge of the tape and the second outer projection folds a second edge of the tape.

21. A method of folding an edge of tape, the method comprising:

receiving tape in an edge folder roller assembly, wherein the edge folder roller assembly comprises:

one or more roller support members; and an edge folder roller operatively coupled to the one or more roller support members to allow rotation of the edge folder roller with respect to the one or more roller support members, wherein the edge folder roller comprises:

an inner portion;

a first outer projection adjacent a first end of the inner portion; and a second outer projection adjacent a second end of the inner portion;

wherein the first outer projection and the second outer projection have an inner projection surface and an outer projection surface, and wherein the inner projection surface is a concave surface;

folding a first edge of the tape using the first outer projection and a second edge of the tape using the second outer projection as the tape moves longitudinally over the edge folder roller and the edge folder roller rotates with respect to the one or more roller support members.

* * * * *